US008151462B2

(12) United States Patent
Franson et al.

(10) Patent No.: US 8,151,462 B2
(45) Date of Patent: Apr. 10, 2012

(54) METHOD OF MAKING A FLOW SHAPER FOR A SPRINKLER ASSEMBLY

(75) Inventors: Scott T. Franson, Hastings, MI (US); Thomas E. Winebrenner, Hastings, MI (US); Shawn G. Orr, Grand Rapids, MI (US)

(73) Assignee: The Viking Corporation, Hastings, MI (US)

( * ) Notice: Subject to any disclaimer, the term of this patent is extended or adjusted under 35 U.S.C. 154(b) by 71 days.

(21) Appl. No.: 12/724,880

(22) Filed: Mar. 16, 2010

(65) Prior Publication Data

US 2010/0170685 A1 Jul. 8, 2010

Related U.S. Application Data

(62) Division of application No. 11/388,070, filed on Mar. 23, 2006, now Pat. No. 7,712,218.

(60) Provisional application No. 60/667,841, filed on Apr. 1, 2005.

(51) Int. Cl.
*B21K 21/08* (2006.01)
*A62C 37/36* (2006.01)

(52) U.S. Cl. ..... 29/890.143; 169/42; 169/37

(58) Field of Classification Search ..... 29/890.141, 29/890.143; 169/19–22, 37–42, 90; 239/461, 239/498, 499, 500, 502, 504, 506, 515, 518, 239/521, 522

See application file for complete search history.

(56) References Cited

U.S. PATENT DOCUMENTS

| | | | | |
|---|---|---|---|---|
| 2,076,483 | A | 4/1937 | Rowley | |
| 3,904,126 | A * | 9/1975 | Allard | 239/502 |
| 4,403,661 | A * | 9/1983 | Tokar | 169/38 |
| 4,405,018 | A * | 9/1983 | Fischer | 169/37 |
| 4,570,720 | A | 2/1986 | Retzloff et al. | |
| 4,623,023 | A | 11/1986 | Retzloff et al. | |
| 5,083,616 | A * | 1/1992 | Polan | 169/40 |
| 5,188,185 | A * | 2/1993 | Mears | 169/37 |
| 5,447,338 | A | 9/1995 | Kikuchi | |
| 5,967,237 | A * | 10/1999 | Sundholm | 169/37 |
| 5,992,532 | A | 11/1999 | Ramsey et al. | |
| 6,276,460 | B1 * | 8/2001 | Pahila | 169/37 |
| 6,367,559 | B1 | 4/2002 | Winebrenner | |
| 6,450,265 | B1 * | 9/2002 | Ponte | 169/37 |
| 6,502,416 | B2 | 1/2003 | Kawasumi et al. | |
| 6,715,561 | B2 | 4/2004 | Franson | |
| 6,848,513 | B2 | 2/2005 | Jackson et al. | |
| 6,918,545 | B2 | 7/2005 | Franson et al. | |

* cited by examiner

*Primary Examiner* — Sarang Afzali
(74) *Attorney, Agent, or Firm* — Harness, Dickey & Pierce, P.L.C.

(57) ABSTRACT

A sprinkler assembly includes a body, a support, which extends from the body, and a closure device that releasably closes the discharge opening of the body. The sprinkler assembly further includes a trigger that releasably holds the closure device at the discharge opening. The support is adapted to allow the fluid flowing from the discharge opening, when the closure device is released, to pass through the support substantially unimpeded by the support and, further, is adapted to reshape the flow of fluid as it flows through the support.

1 Claim, 42 Drawing Sheets

METHOD OF MAKING A FLOW SHAPER FOR A SPRINKLER ASSEMBLY

CROSS-REFERENCE TO RELATED APPLICATIONS

This application is a divisional of U.S. patent application Ser. No. 11/388,070, filed on Mar. 23, 2006, now U.S. Pat. No. 7,712,218, which claims the benefit of U.S. Provisional Application No. 60/667,841, filed on Apr. 1, 2005, the disclosures of which are incorporated herein by reference.

BACKGROUND

The statements in this section merely provide background information related to the present disclosure and may not constitute prior art.

The present disclosure relates to a sprinkler assembly and, more particularly, to a sprinkler assembly that exhibits reduced energy losses, which may be used in both residential and commercial applications, including storage applications, and further may be used in a control mode or a suppression mode.

Significant energy losses occur at the sprinkler assemblies where the fluid is dispersed. Conventional sprinkler assemblies include a base with a passageway, an inlet opening, and a discharge opening, which is adapted for connecting to the system piping, and a deflector that is supported spaced from the base, typically by a pair of arms that extend from the base. The arms are often joined at their distal ends by a boss, which is used to mount the deflector to the arms. Pendent sprinklers and upright sprinklers typically include deflectors with a solid central portion and a plurality of tines that extend radially outwardly from the central portion for dispersing the fluid as it flows across the solid central portion, which is mounted to the boss and typically aligned with the discharge opening of the base. Sidewall sprinklers typically include a deflector, also with a solid central portion with tines extending from the central portion and a blade that is positioned above the central portion to direct the fluid that flows above the central portion outwardly and downwardly. In each case, when the fluid flows from the discharge opening of the base the fluid impinges on the boss and on the central portion of the deflector. The boss and deflector disperse the fluid radially outward, and the fluid is thereafter further dispersed by the tines, and in the case of the sidewall sprinklers also by the blade. This results in a sizeable energy or head loss in the fluid at the sprinkler assembly. Significant savings can be realized for a sprinkler system if the supply pressure to the sprinkler assembly can be reduced. As would be understood by those skilled in the art, where the supply pressure to the sprinkler assemblies of a system can be reduced, the size of the piping delivering the fluid to the sprinkler assemblies can be reduced and/or the size of the system pump can be downsized. If comparable performance of a sprinkler assembly can be provided at a lower pressure for any given system, the need for a pump might even be avoided. Any of these modifications could provide significant savings in the installation cost of a fire protection system. Accordingly, a sprinkler assembly that can disperse fluid with a reduced head loss may reduce the required pressure at the sprinkler assembly and, hence, provide cost savings for the installation of a fire protection system incorporating such sprinkler assemblies.

SUMMARY

According to the present invention a sprinkler assembly is provided that is adapted to reduce the energy and hence head loss of a fluid as it flows from the sprinkler assembly.

In one form of the invention, a sprinkler assembly includes a body and a support extending from the body. The body includes a passageway, an inlet opening, and a discharge opening. In addition, the sprinkler assembly includes a flow-shaper member and a closure device releasably positioned at the discharge opening to close the passageway. A heat responsive trigger is mounted to releasably retain the closure device at the discharge opening of the body and release the closure device from the discharge opening when the heat responsive trigger is heated to a temperature associated with a fire. The flow-shaper member has at least one contact surface for shaping the flow of fluid from the discharge opening when the closure device is released from the discharge opening. The support and the flow-shaper member are configured so that they do not block the flow of fluid from the discharge opening along the axis of the body to reduce the impediment to the flow of fluid from the discharge opening when the closure device is released from the discharge opening and thereby reduce the head loss in the fluid flowing from the sprinkler assembly.

In one aspect, the support has an opening aligned along the axis of the body wherein at least some of the fluid flowing from the discharge opening flows through the opening. For example, the support's opening may have a diameter of at least 0.4 inch and, more typically, in a range of about 0.5 to 2.0 inches.

In another aspect, the flow-shaper member may be located at the support's opening so that the support's opening is adapted to shape the flow of fluid flowing from the opening. For example, the flow-shaper member may be located at the discharge side of the support's opening. A suitable flow-shaper member may be formed by a tab or a tine.

In further aspects, the flow-shaper member projects from the frame at the support's opening away from the discharge opening. In addition, the sprinkler assembly may include an annular member positioned in the support's opening, which supports the flow-shaper member at the support's opening. For example, the annular member may be located in the support's opening. Where more than one flow-shaper member is provided, the annular member may support all the flow-shaper members at the support's opening to thereby shape the flow of fluid flowing from the support's opening.

In further aspects, the heat responsive trigger includes a heat sensitive member that extends between the support and the body. For example, the heat sensitive member may have a longitudinal axis that extends between the support and the body, with the longitudinal axis angled with respect and non-parallel to the axis to thereby further reduce impediments to the flow of fluid flowing from the discharge opening of the body.

In another aspect, the discharge coefficient or "K" factor of the sprinkler assembly, which equals the flow of fluid, such as water, in gallons per minute through the passageway divided by the square root of the pressure of fluid fed into the body in pounds per square inch gauge, may be in a range of about 2.8 to 50.4 so that the sprinkler assembly may be suitable for use in residential or commercial applications, including storage applications.

In yet another aspect, the Response Time Index (RTI) of the sprinkler may be 50 $(m-s)^{1/2}$ or less, and optionally may be in a range of 50 to 300 $(m-s)^{1/2}$.

In another form of the invention, a sprinkler assembly includes a body and a support that extends from the body. The support has a transverse member with an opening at least generally aligned along the axis of the body that is larger in diameter than the discharge opening of the sprinkler body wherein at least some, and preferably most, of the fluid flowing from the discharge opening flows through the support.

In one aspect, the opening is adapted to shape the flow of fluid flowing from the opening. For example, the sprinkler assembly may include a flow-shaper with one or more flow-shaper members at or near the opening of the support.

According to another form of the invention, a sprinkler assembly includes a body and a frame that extends from the body. The frame has an opening at least generally aligned along the axis of the body that is larger in diameter than the discharge opening of the sprinkler body wherein at least some, and preferably most, of the fluid flowing from the discharge opening flows through the opening of the frame. In addition, the sprinkler assembly includes a flow-shaper member provided at the discharge side of the frame's opening, which shapes the flow of fluid flowing from the opening of the frame.

In yet another form of the invention, a sprinkler assembly includes a body, a support, which extends from the body, and a heat sensitive trigger. The body includes an inlet opening, a passageway extending from the inlet opening to a discharge opening, and an axis that extends from the discharge opening. The trigger includes a heat sensitive member that extends between a mounting surface of the support and the body, with the mounting surface being offset from the axis of the body. In this manner, the heat sensitive member is offset from the axis to reduce the impediment to the flow of fluid flowing from the discharge opening when the discharge opening is opened and thereby reduce the energy loss in the fluid flowing from the discharge opening.

In one aspect, the support comprises a frame with a pair of arms. The frame includes an opening that is aligned along the axis wherein fluid flows through the frame. In a further aspect, the frame's opening is sized so that most, if not all, the fluid flows from the discharge opening of the body flows through the frame. For example, the frame's opening may be sized so that its diameter is at least as large as the diameter of the discharge opening.

In another aspect, the axis comprises a central axis that extends through the centers of each of the inlet and discharge openings.

In other aspects, the sprinkler assembly includes at least one fluid flow-shaper member at the frame, which shapes the flow of fluid passing through the frame. Optionally, the flow-shaper member is provided at the frame's opening and, further, optionally mounted in the opening of the frame. For example, the flow-shaper member may comprise a tab, which is located adjacent the opening of the frame to thereby shape the flow of fluid flowing from the opening of the frame. In a further aspect, the sprinkler assembly includes a pair of flow-shaper members. For example, the flow-shaper members may be generally aligned on opposed sides of the frame's opening and offset from the axis of the body to thereby at least partially envelop the flow of fluid as it flows from the frame's opening.

In further aspects, the sprinkler assembly includes an annular member and a pair of tabs that extend from the annular member. The tabs form a pair of flow-shaper members. For example, the annular member may be mounted in the frame's opening wherein fluid flowing through the frame's opening flows through the annular member.

According to yet another aspect, the body of the sprinkler includes an insert, which forms the discharge opening. For example, the insert may include a support surface for supporting the heat sensitive member and, preferably, a support surface that is angled with respect to the axis of the body. In this manner, when the heat sensitive member is compressed between the body and the mounting surface, the compression forces will be aligned along the longitudinal axis of the heat sensitive member. Suitable heat sensitive members include a frangible bulb or the like.

Accordingly, the present disclosure provides a sprinkler assembly that is adapted to reduce the head loss of the fluid as it flows from the sprinkler assembly, thus, potentially reducing the required supply pressure to the sprinkler assembly or increasing the pressure of the fluid as it is dispersed from the fire suppressant system or a combination of both. As would be understood by those skilled in the art, where the supply pressure to the discharge devices of the system can be reduced, the size of the piping delivering the fire suppressant fluid to the discharge devices can be reduced and/or the size of the pump can be downsized. In some cases, the pump may be eliminated. Thus, the sprinkler assembly of the present disclosure potentially provides for significant savings in the cost of the system.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
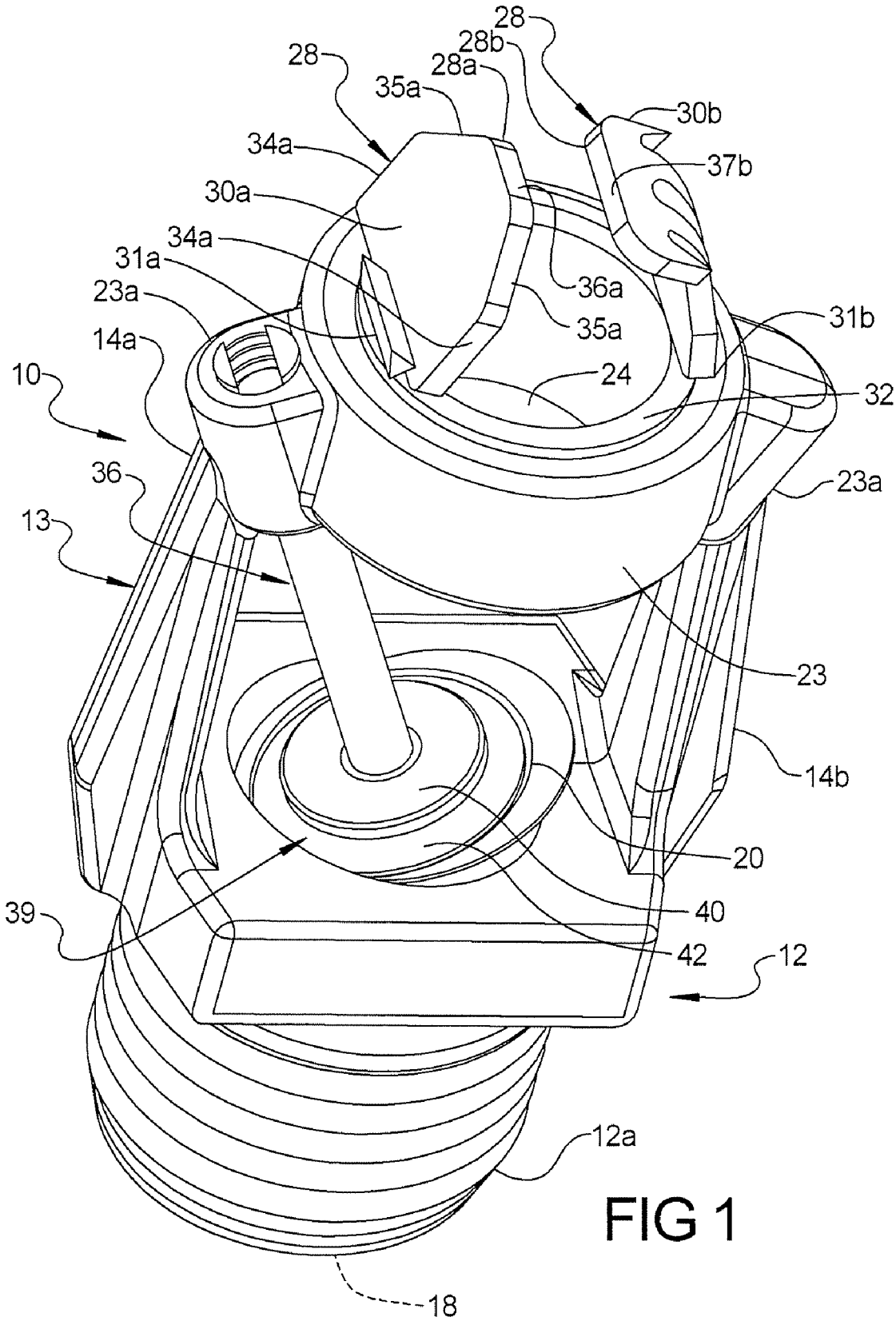
FIG. 1 is a perspective view of a sprinkler assembly of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, the numeral 10 generally designates a sprinkler assembly of the present invention. As will be more fully described below, sprinkler assembly 10 is configured and arranged to reduce the energy loss of the fluid as it flows from the sprinkler assembly 10. The term "fluid" is used broadly herein and includes substances that are capable of flowing, for example, water, foam, water/foam mixture, gas, powder, and other known fire suppressant materials. In the illustrated embodiment, sprinkler assembly 10 is illustrated as a sidewall sprinkler assembly 10; however, as will be more fully appreciated from the description that follows, the sprinkler assembly of the present invention may comprise a pendent sprinkler assembly or an upright sprinkler assembly. In addition, as described below, the various sprinklers of the present invention may be used in residential or commercial applications, including storage applications, and, further, may be configured to operate in a control mode or a suppression mode. Hence, their "K" factor may vary, where the "K" factor equals the flow of fluid, such as water, in gallons per minute through the passageway divided by the square root of the pressure of fluid fed into the inlet of the sprinkler body in pounds per square inch gauge. For example, the "K" factor of the sprinkler assemblies of the present invention may be in a range of about 2.8 to 50.4.

Further, any one of the sprinkler assemblies of the present invention may be configured as a fast response sprinkler as defined by the response time index. The response time index of a sprinkler is referred to as "RTI", which is a measure of the sensitivity of the thermal element of a sprinkler. RTI is usually determined by plunging a sprinkler into a heated laminar airflow within a test oven. RTI is calculated using operating time of the sprinkler, operating temperature of the sprinkler's heat-responsive element (as determined in a bath test), air temperature of the test oven, air velocity of the test oven, and the sprinkler's conductivity. Fast response sprinklers have an RTI typically less than 50 $(m-s)^{1/2}$.

As will be more fully described below, the sprinkler assemblies of the present invention reduce the friction between the fluid and the sprinkler assembly and, hence, the energy loss of the fluid as it flows from the sprinkler assembly. Consequently, a sprinkler assembly of the present invention provides an optimally-sized sprinkler that will be able to cover greater areas for a given pressure than conventional sprinklers of the same size.

As best seen in FIGS. 1-4, sprinkler assembly 10 includes a sprinkler body 12, a support 13 that extends from body 12, and one or more fluid flow-shaper members 28. Body 12 and support 13 preferably comprise a brass casting. Though, it should be understood that the body and support may be separately formed and, further, may be formed from other materials and by other forming methods. Body 12 comprises a generally tubular body with a threaded portion 12*a* for connecting the sprinkler assembly to a fluid supply line and, further, includes an inlet opening 18, a discharge opening 20, and a fluid passageway 22. Passageway 22 extends between inlet opening 18 through threaded portion 12*a* to discharge opening 20 so that when body 12 is coupled to the supply line and sprinkler assembly 10 is opened or actuated, such as in the case of a fire, fluid will flow from inlet opening 18 through passageway 22 and out from discharge opening 20.

Figure 4:
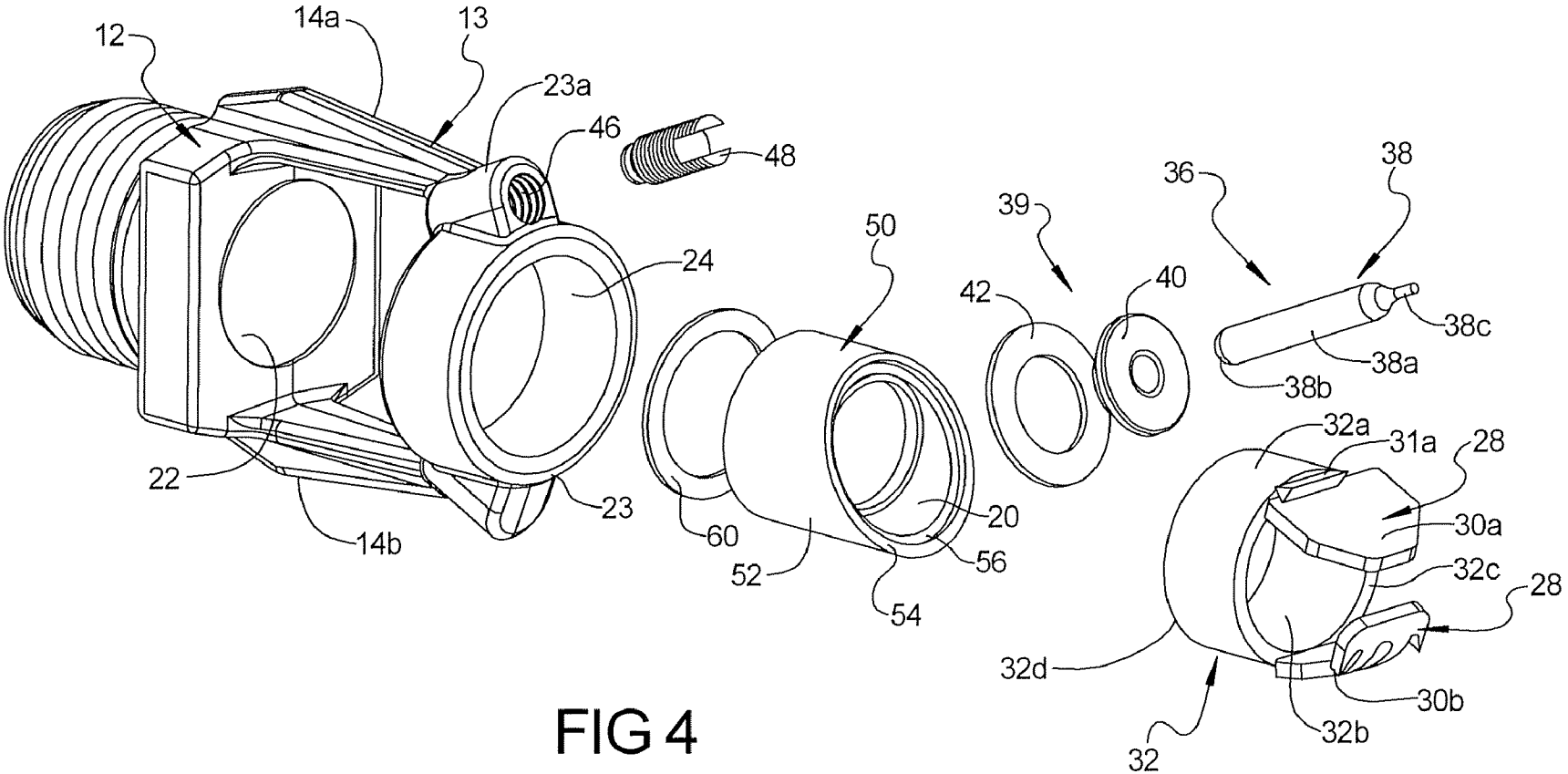
FIG. 4 is an exploded perspective view of the sprinkler assembly of FIG. 1.
Figure 5:
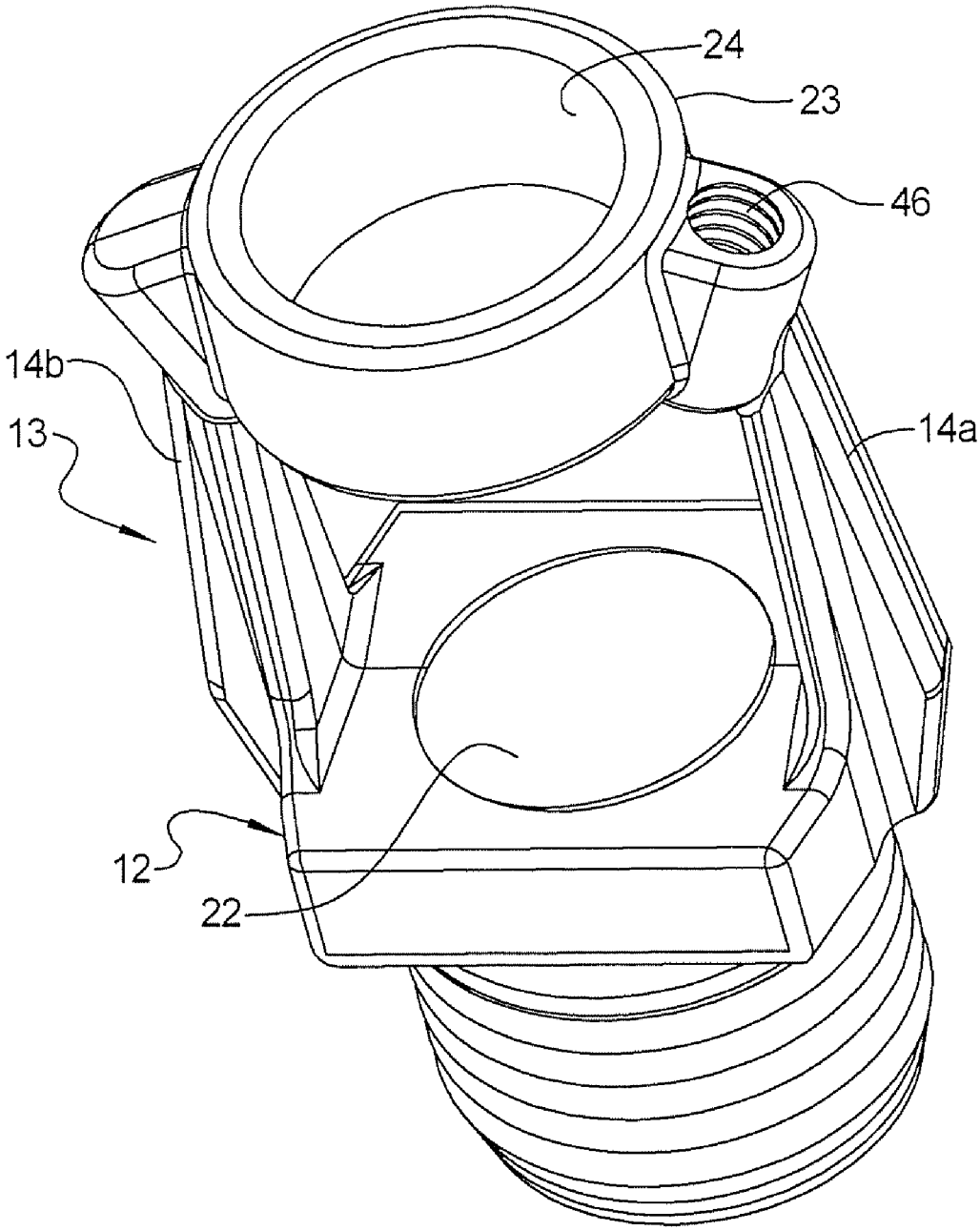
FIG. 5 is an enlarged perspective view of the sprinkler assembly with the flow-shaper members and trigger removed for clarity.

As best seen in FIG. 4, sprinkler assembly 10 further includes a closure device (39) releasably positioned at discharge opening 20 of body 12 to close passageway 22 and a heat responsive trigger 36 mounted in a manner to releasably retain closure device 39 at discharge opening 20 of body 12 to thereby maintain passageway 22 closed until trigger 36 is activated.

To reduce the energy loss of the fluid as it flows from sprinkler assembly 10, support 13 is configured to allow at least a portion and, optionally most, if not all, of the fluid to flow through support 13 rather than into and around the support 13. In addition, as will be more fully described below, at least a portion, and optionally most of the fluid flows between one or more flow-shaper members 28, which direct and shape the fluid in a desired pattern in contrast to conventional sprinkler assemblies that typically include frames and deflectors that deflect and redirect the fluid and form barriers around which the fluid must flow.

In the illustrated embodiment, support 13 comprises a frame that includes a pair of arms 14*a* and 14*b* and a transverse member 23 that joins the ends of arms 14*a* and 14*b* and which is spaced from discharge opening 20. Arms 14*a* and 14*b* extend generally away from discharge opening 20 on opposed sides of body 12 and, as noted, are joined by transverse member 23. While two symmetrically positioned arms are illustrated, it should be understood that support 13 may include one, two, three, or four or more arms, for example three or four arms that are all symmetrically positioned around and spaced away from axis 26. As would be understood by those skilled in the art, support 13 is substantially rigid so as to provide support for the flow-shaper members and, further, support for a heat responsive trigger, as will be more fully described below.

In the illustrated embodiment, transverse member 23 of support 13 comprises an annular member and a pair of bosses 23*a* that align and mount the annular member 23 between arms 14*a* and 14*b*. The annular member provides an opening 24 with a center 24*a* (FIG. 3) that is at least generally aligned along axis 26 (FIG. 3) of sprinkler assembly 10 and over discharge opening 20. Axis 26 extends through body 12 and through inlet opening 18, discharge opening 20, and fluid passageway 22. In the illustrated embodiment axis 26 comprises a generally central axis that passes through the centers of the inlet and discharge openings. The alignment of the discharge opening 20 and opening 24 in the transverse member allows the body 12 and support 13 to be integrally molded by a casting process wherein a single core member or a pair of coaxial core member scan be utilized to form the openings 20 and 24.

The opening or the inner diameter 24 of the annular member is at least 0.4 inches in diameter and, more typically, in a range of about 0.5 to 2.5 in diameter. Further, opening 24 may be at least as large in diameter as discharge opening 20 and, further, may be larger in diameter than discharge opening 20. In this manner, the flow of fluid from body 12 is substantially unimpeded by support 13 and, instead, may flow through support 13 through opening 24. As a result, the flow of fluid is directed and shaped rather than redirected. Consequently, the energy loss of the fluid as it flows through the frame is reduced, if not eliminated. Furthermore, although opening 24 is depicted as a right cylindrical opening with straight sides, the inner surface of opening 24 may be tapered inwardly or outwardly. In addition, opening 24 may have a non-circular cross-section.

Figure 3:
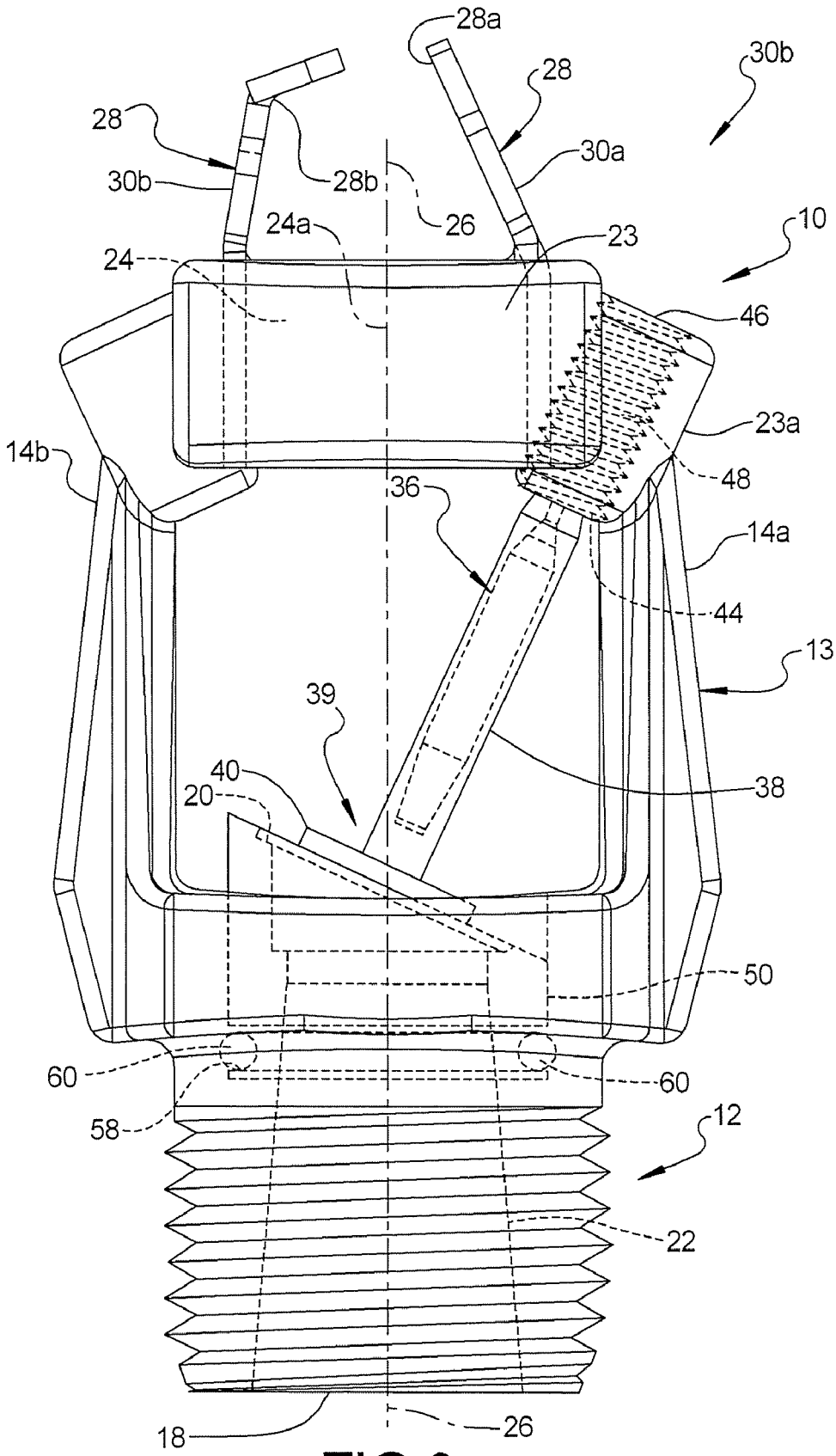
FIG. 3 is a similar view to FIG. 2 illustrating in phantom the internals of the sprinkler assembly.

In order to then direct the fluid in a desired spray pattern, one or more fluid flow-shaper members 28 are located adjacent or at opening 24. Further, flow-shaper members 28 may be offset from axis 26 of the sprinkler head body. As best seen in FIG. 3, fluid flow-shaper members 28 include inwardly facing surfaces 28*a* and 28*b* that are angled with respect to axis 26 and, further, because they are offset from axis 26 they at least partially envelop the column of fluid as it flows from discharge opening 20 and through opening 24 to thereby shape the flow of the fluid so that it flows in a desired direction and/or pattern. For example, in a sidewall sprinkler, fluid flow-shaper members 28 direct the flow of fluid outwardly and downwardly, with some of the fluid lifted to project the fluid across the room, for example, and some of the fluid directed laterally downward to provide wall wetting. It should be understood, therefore, that fluid flow-shaper members 28 may be configured to direct fluid uniformly or direct fluid in some directions more than in other directions.

Figure 2:
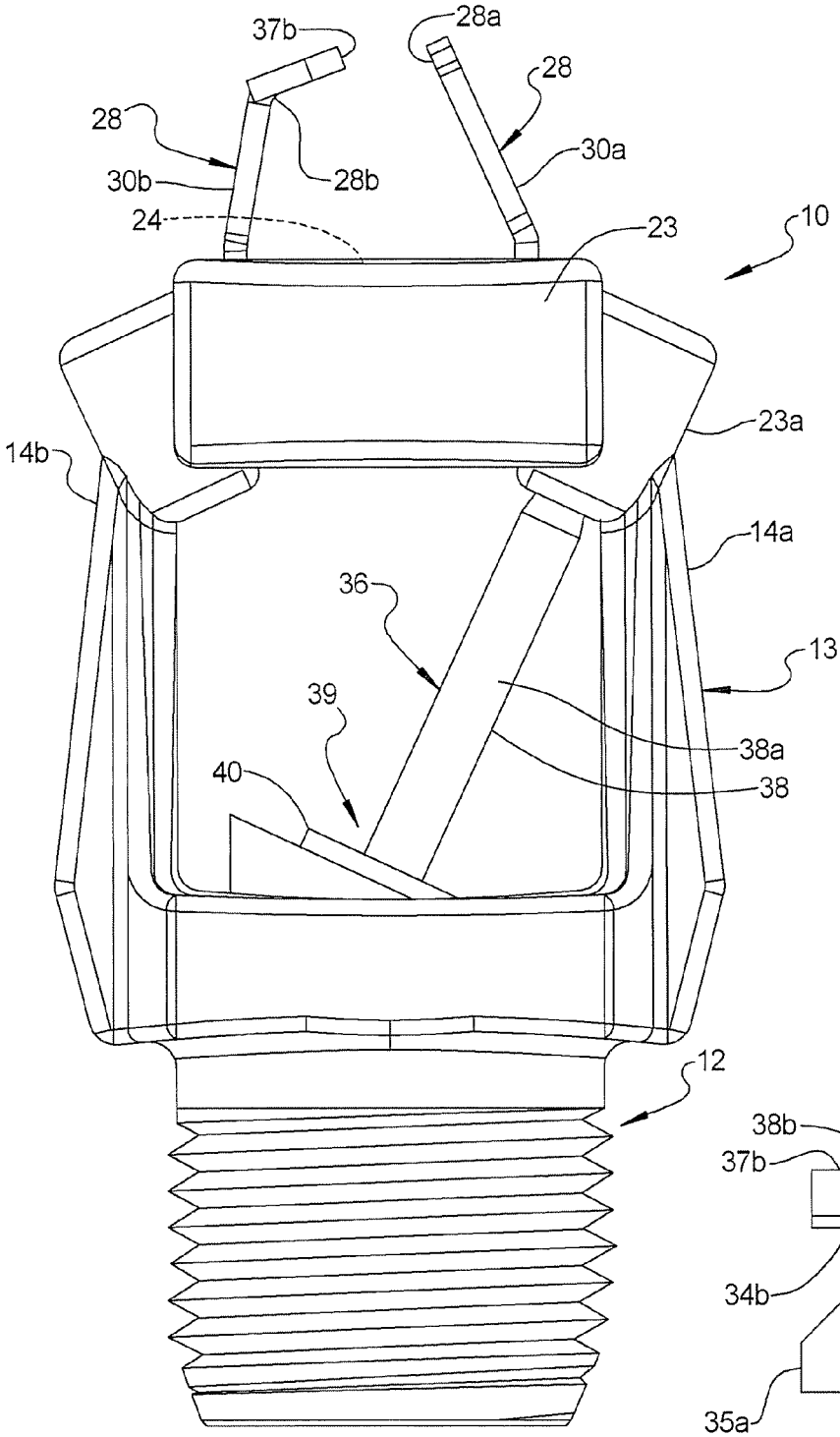
FIG. 2 is a side view of the sprinkler assembly of FIG. 1.

Referring to FIG. 2, when fluid flows from discharge opening 20, the fluid generally forms a column of fluid, which is substantially unencumbered by any structure until it contacts flow-shaper members 28. In other words, sprinkler assembly 10 has a flow path from discharge opening 20 that is unencumbered by frame 14. Furthermore, when the fluid is contacted by flow-shaper members 28, flow-shaper members 28 operate on the column of fluid from its outer surface radially inward—in contrast to a conventional deflector and frame, which act as abutments and then redirect the fluid and spread the column of fluid generally from its center to fan the fluid radially outward and, thereafter, disperses the fluid as the fluid flows around the deflector. As would be understood, therefore, in a conventional sprinkler, the fluid experiences significant energy loss due to the friction and deflection between the fluid and the frame and the deflector.

In the illustrated embodiment, fluid flow-shaper members 28 are formed as a pair of tabs 30*a* and 30*b* that are mounted to or formed with an annular member 32, which together form a flow-shaper. It should be understood that the number of tabs, the size of the tabs, the shape of the tabs, and the location of the tabs may vary depending upon the desired fluid dispersement pattern. Annular member 32 includes an annular wall 32*a* and central opening 32*b*. In addition, annular member 32 includes a first and second ends 32*c* and 32*d* and is sized to fit and mount in opening 24 of support 13 and, further, configured so that the fluid flows through annular member 32. In this manner, the fluid flow-shaper members are attached to support 13 by mounting annular member 32 in support 13. It should be understood that flow-shaper members 28 may alternatively be attached to support 13 by attaching flow-shaper members 28 to support 13, for example by welding the flow-shaper members to the support, such as to annular member 23, or by integrally forming the support 13 with the flow-shaper members. Flow shaper members 28 can be formed, cut or otherwise machined into the support structure so as to be formed integrally therewith. Alternately, tabs 30*a* and 30*b* may be mounted by a member that mounts about support 13 and annular member 23 outwardly of opening 24.

In this application, opening 32*b* of annular member 32 is preferably at least as large in diameter as discharge opening 20. In this manner, most, if not all, the fluid discharged from discharge opening 20 may flow through support 13 unimpeded by support 13 or annular member 32.

As best seen in FIGS. 1 and 4, tab 30*a* comprises a solid, generally polygon-shaped plate with a base 31*a* that attaches the tab to or is formed with the annular member 32 at first end 32*c*. The plate includes spaced, generally parallel edges 34*a* that extend laterally outward from annular member 32. At its outer end, the plate includes angled edges 35*a* that taper inwardly from edges 34*a* and terminate at a transverse edge 36*a* that extends generally transverse across opening 32*b* and opening 24. The width (FIG. 1) of tab 30*a* may fall in a range of 0.300 to 3.000 inches. The length of tab 30*a* may fall in a range of 0.200 to 1.300 inches. It should be understood that other shapes and sizes may also be utilized.

Figure 2A:
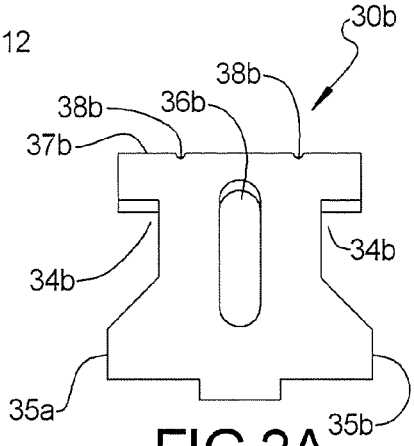
FIG. 2A is an enlarged fragmentary view of one of the flow-shaper members of the sprinkler assembly of FIG. 2.

Tab 30*b* also attaches to or is formed with annular member 32 at first end 32*c* by a base 31*b* and comprises a generally rectangular plate with trapezoidal-shaped notches 34*b* at its opposed edges 35*b*, as best shown in FIG. 2A. In addition, tab 30*b* may include one or more slotted openings 36*b*. Slotted opening 36*b* allows some of the fluid to flow through tab 30*b*, as would be understood by those skilled in the art. The number, size, and shape of slotted openings 36*b* can be varied in order to obtain a desired flow pattern. At its outer end, the plate is bent or curved toward tab 30*a* with its outer edge 37*b* extending generally parallel to edge 36*a* of plate 30*a*. In addition, edge 37*b* may include a pair of notches 38*b* (FIG. 2A). In this manner, tab 30*b* is arranged to lift some of the fluid flowing from opening 24 and to fan the fluid laterally outward and downward. The width (FIG. 1) of tab 30*b* may fall in a range of 0.3 to 3 inches. The length (FIG. 3) of tab 30*b* may fall in a range of 0.2 to 1.3 inches, although other sizes may be utilized depending upon the desired flow pattern.

In the illustrated embodiment, tabs 30*a* and 30*b* extend from end 32*c* from opposed sides and are generally aligned along an axis 30*c* that extends through the center axis 32*e* of annular member 32. However, it should be understood that tabs 30*a*, 30*b* or additional tabs may be located at other locations around end 32*c* depending on the desired spray pattern.

As noted above, trigger 36 is mounted so as to retain closure device 39 in position over discharge opening 20. In the illustrated embodiment, trigger 36 comprises a heat sensitive member 38 that is mounted between support 13 and closure device 39. Heat sensitive member 38 is supported on one end in closure device 39, which includes a generally cup-shaped member or support 40 that supports one end of member 38 at opening 20. In addition, closure device 39 includes an annular spring seal 42 (FIG. 4) positioned between support 40 and body 12 about opening 20, which urges support 40 outwardly from body 12 when heat sensitive member 38 is triggered by a temperature associated with a fire and releases its compression forces on seal 42.

The opposed end of heat sensitive member 38 is supported in a recess 44 formed in frame 14 (best shown in FIG. 3), which includes a transverse opening 46 therethrough for receiving a set screw 48. Set screw 48 applies a compressive force on the opposed end of member 38, which in turn applies a compressive force on support 40 to compress seal 42 against body 12 to thereby seal opening 20.

In the illustrated embodiment, boss 23*a* at the juncture of annular member 23 and arm 14*a* provides recess 44. As best seen in FIG. 3, recess 44 provides a mounting surface that is offset from axis 26 of sprinkler assembly 10. Similarly, opening 20 is provided by an insert 50 that is inserted into passageway 22, which provides an angled support surface for the lower end of heat sensitive member 38. As best shown in FIG. 4, insert 50 comprises a cylindrical member, such as an annular cylindrical member 52, with an angled annular surface 54 at or adjacent its outer end that forms an angled seat 56 for seal 42 to thereby provide the angled support surface for the opposed end of heat sensitive member 38. In this manner, the compressive forces applied to heat sensitive member 38 are aligned along its longitudinal axis. As would be understood, the size and stiffness of frame 14 permits heat sensitive member 38 to be loaded along its longitudinal axis, which is offset from the axis of sprinkler assembly. In addition, by providing an angled support surface (seat 56) for the end of heat sensitive member 38, the forces on seal 42 are then preferably oriented so that minimal or no lateral forces are generated at seal 42, which otherwise could potentially dislodge seal 42 from being seated on body 12 and sealing opening 20.

As best seen in FIG. 3, insert 50 rests on a shoulder 58 provided in passageway 22 of body 12. In order to seal insert 50 in passageway 22, an annular seal 60 is provided between shoulder 58 and insert 50. However, it should be understood that the angled seat or support surface for heat sensitive member 38 may be otherwise provided or formed, such as by machining the angled surface into body 12. In this manner, the offset of the trigger also minimizes the impediment to the flow of fluid flowing from the body of the sprinkler assembly 10.

In the illustrated embodiment, heat sensitive member 38 comprises a heat sensitive frangible bulb 38*a*. Furthermore, the wider, rounded end 38*b* of bulb 38*a* is seated in support 40. The narrower, reduced neck 38*c* of bulb 38*a* is inserted into recess 44. Thus, bulb 38*a* is inverted from a conventional sprinkler application—where the narrower, reduced neck of the glass bulb is typically inserted into the discharge orifice of the sprinkler head.

As noted above, though illustrated as a sidewall sprinkler assembly, the sprinkler assembly of the present invention may comprise an upright or pendent style sprinkler assembly. In addition, the sprinkler assembly may comprise a residential sprinkler or a commercial sprinkler, including a storage sprinkler. Therefore, the discharge coefficient or "K-factor" of the sprinkler assembly may vary widely from 2.8 to 50.4. For example, for a residential sprinkler, the K-factor normally ranges from about 2.8 to 8. For a commercial non-storage sprinkler, the K-factor will normally range from about 2.8 to 8.0. For a storage sprinkler, the K-factor will be the largest, typically from about 11.2 to 50.4. It should also be noted that annular member 32 with flow-shaper members 28 may be changed to provide different distribution patterns without modifying annular member 23. Thus, the cast component of sprinter 10 can remain unchanged while the annular member 32 and flow-shapers 28 can be modified inexpensively to obtain desired distribution patterns. Furthermore, the orifice size through the seal insert 50 may be inexpensively changed to provide different K-factors while the remaining components can remain unchanged.

Figure 6:
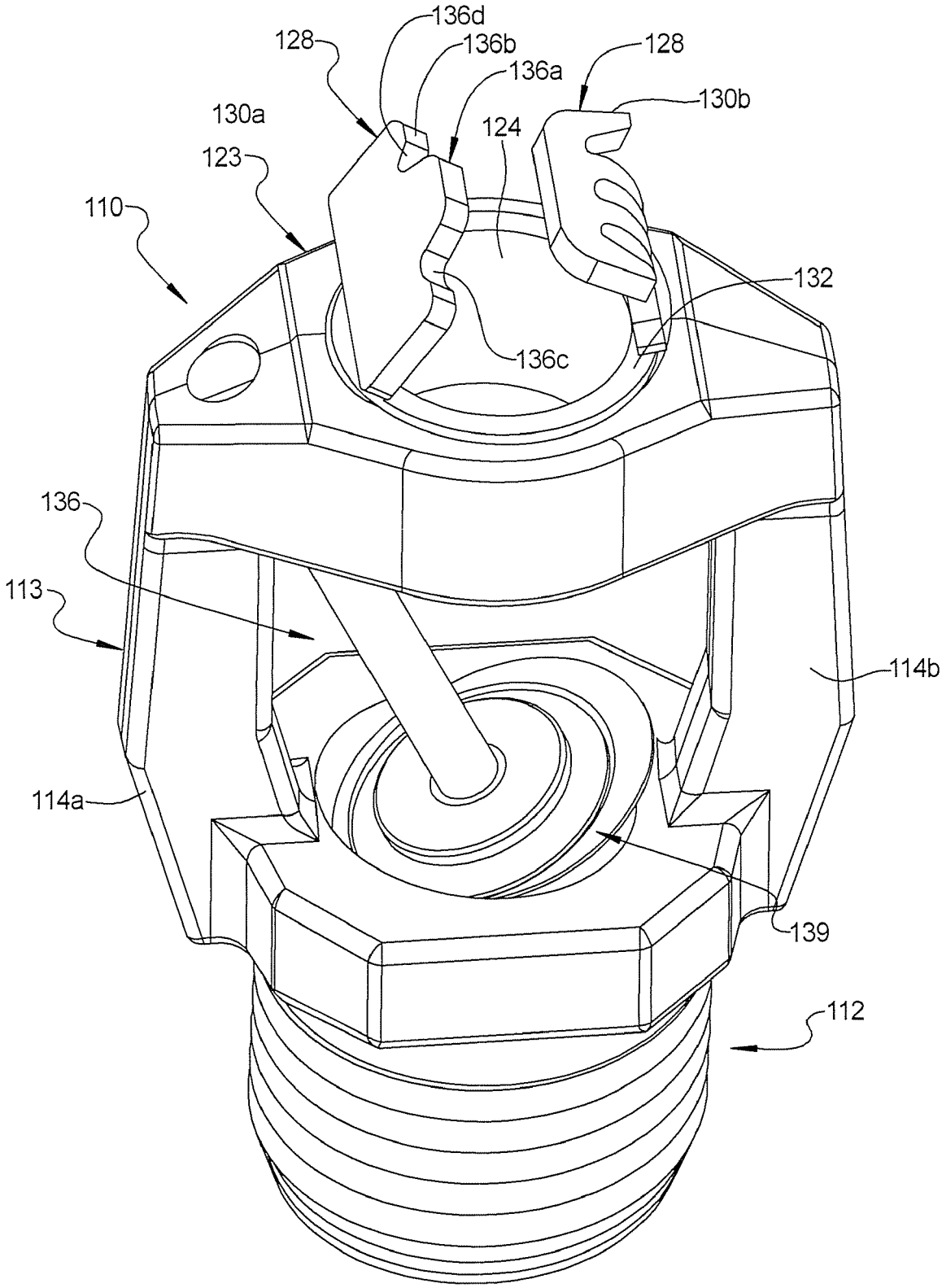
FIG. 6 is a perspective view of another embodiment of the sprinkler assembly of the present disclosure.
Figure 7:
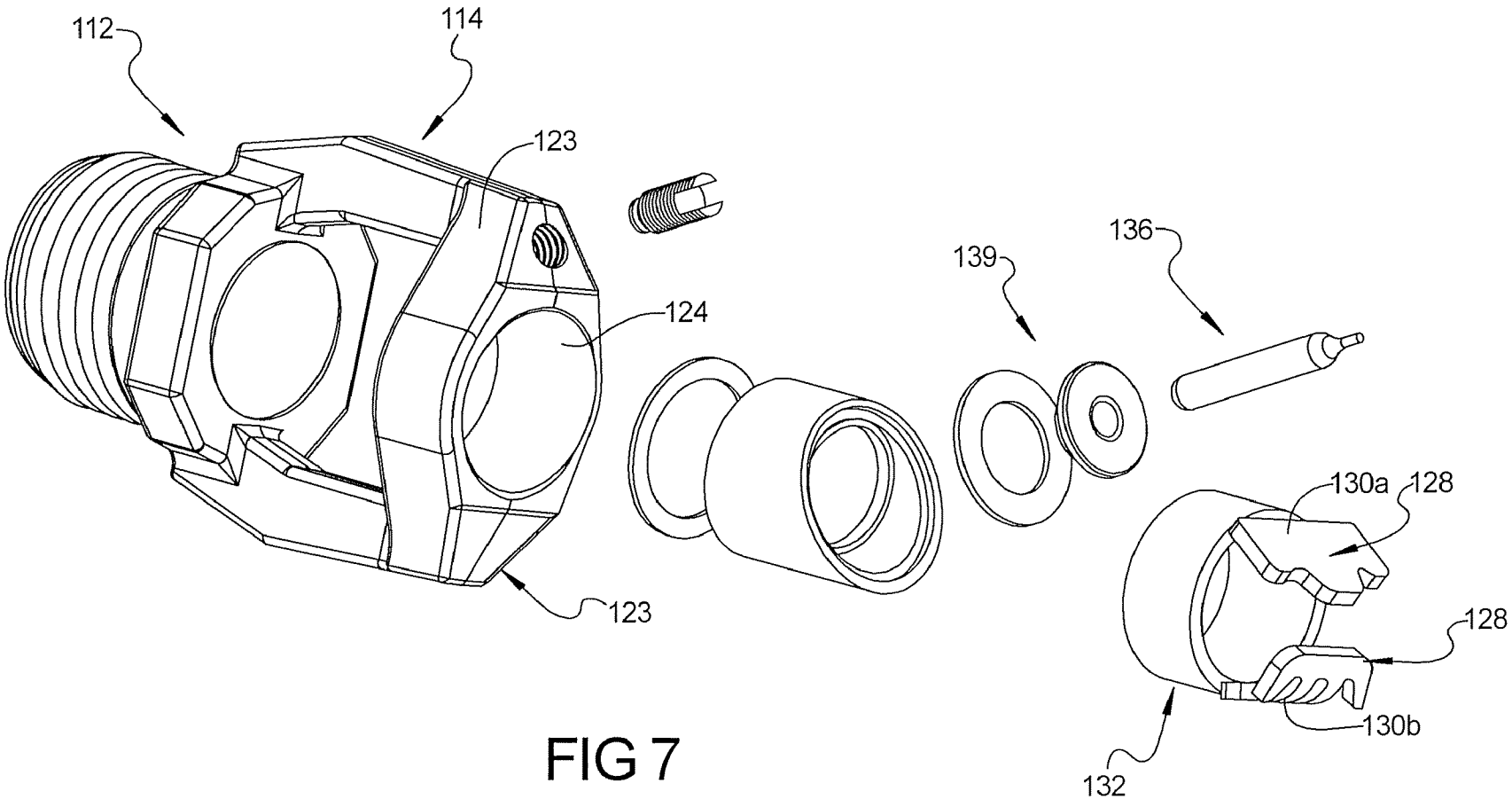
FIG. 7 is an exploded perspective view of the sprinkler assembly of FIG. 6.

Referring to FIG. 6, the numeral 110 generally designates a second embodiment of the sprinkler assembly of the present invention. Sprinkler assembly 110 is of similar construction to sprinkler assembly 10 and includes a body 112, a support 113, in the form of a projecting frame, a heat sensitive trigger 136, which extends between body 112 and support 113 in a similar manner to trigger 36, and a closure device 139. For further details of closure device 139 and trigger 136 reference is made to the closure device 39 and trigger 36 of the previous embodiment.

In the illustrated embodiment the shape of body 112 and frame arms 114*a* and 114*b* have been slightly modified, with arms 114*a* and 114*b* having a generally rectangular cross-section; though it should be understood that the shape of the frame and body may be varied. In addition, frame arms 114*a* and 114*b* are joined at their respective ends by a transverse member 123 formed from a generally oval-shaped body with an opening 124, which is also at least generally aligned with the discharge opening 120 of body 112. For further general details of body 112, trigger 136, and frame 114, and the size of the openings, reference is made herein to sprinkler assembly 10.

In the illustrated embodiment, flow-shaper members 128 are similarly provided by a pair of tabs 130*a* and 130*b* mounted to or formed with an annular member 132 to form a flow-shaper. However, the configuration of tab 130*a* is modified from tab 30*a* and includes at its outer free edge 136*a* a central flat edge 136*b* bounded by a pair of arcuate-shaped edges 136*c* and 136*d*. Arcuate-shaped edges 136*c*, 136*d* may be semi-circular, for example, and provide additional dispersion of the fluid as it flows between the two flow-shaper members. The edges 136*a* through 136*d* define a finger shape that distributes the water in a desired pattern. It should be noted that multiple fingers may be desired to achieve different distribution patterns.

Similar to the previous embodiment, annular member 132 mounts tabs 130*a* and 130*b* in opening 124 so that the flow-shaper members shape the flow of fluid as it flows from frame 114. Further, annular member 132 has an opening that is preferably at least as large and, more preferably, larger than the discharge opening of body 112, similar to the previous embodiment.

Figure 8:
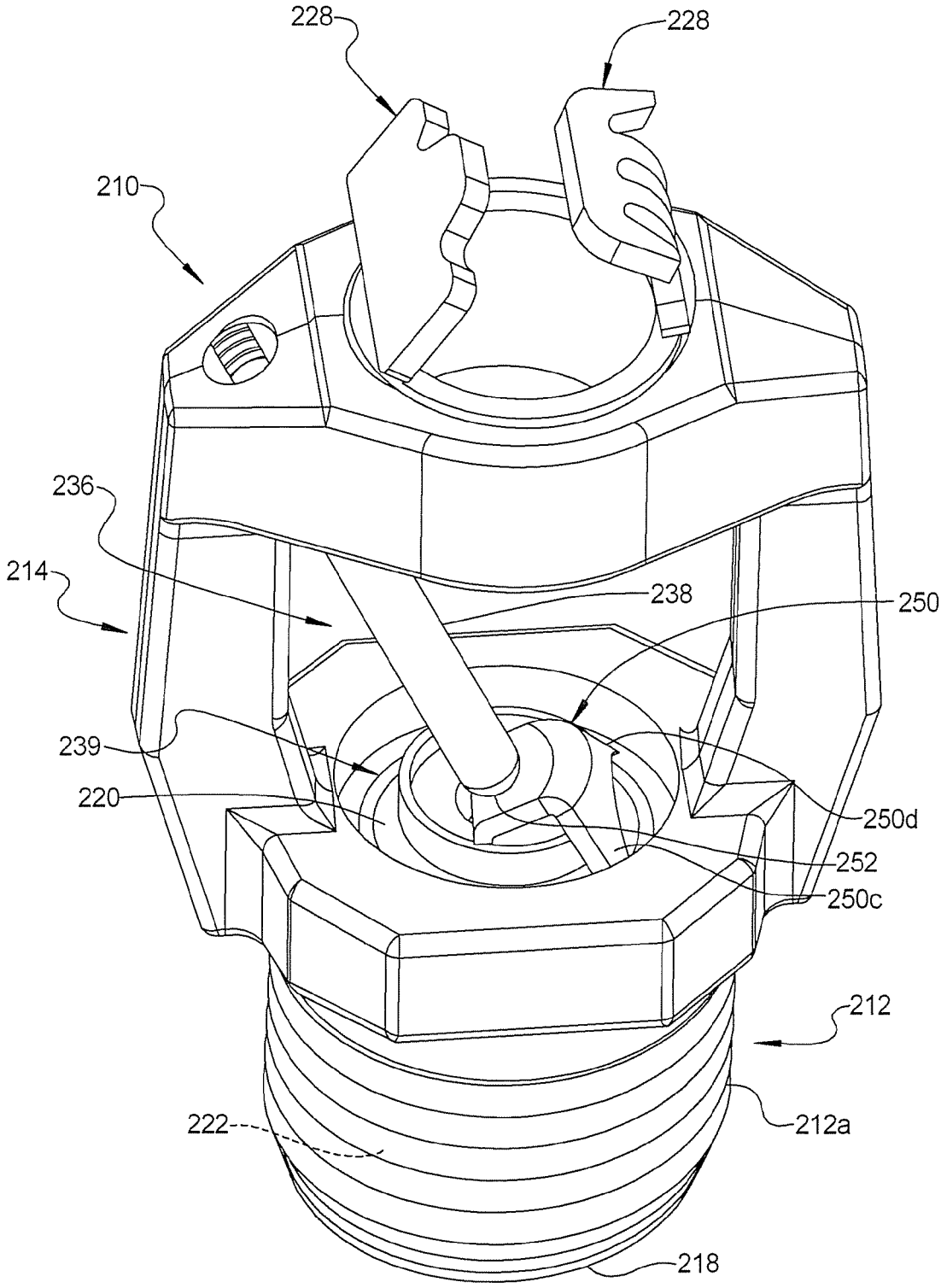
FIG. 8 is a perspective view of a third embodiment of the sprinkler assembly of the present disclosure.

Referring to FIG. 8, the numeral 210 generally designates a third embodiment of the sprinkler assembly of the present invention similar to sprinkler assembly 110 but with a modified body 212, trigger 236, and closure device 239. Therefore, for the details of frame 214 and flow-shaper members 228, reference is made to frame 114 and flow-shaper members 128.

In the illustrated embodiment, body 212 includes a threaded portion 212*a* for connecting the sprinkler assembly to a fluid supply line, an inlet opening 218, a discharge opening 220, and a fluid passageway 222. Passageway 222 extends between inlet opening 218 through portion 212*a* to discharge opening 220, which extends in a plane generally parallel and spaced from the plane of inlet opening 218. In this manner, a conventional body may be employed and, as will be more fully described, retrofit to accommodate the angularly offset heat sensitive member 238.

Figure 9:
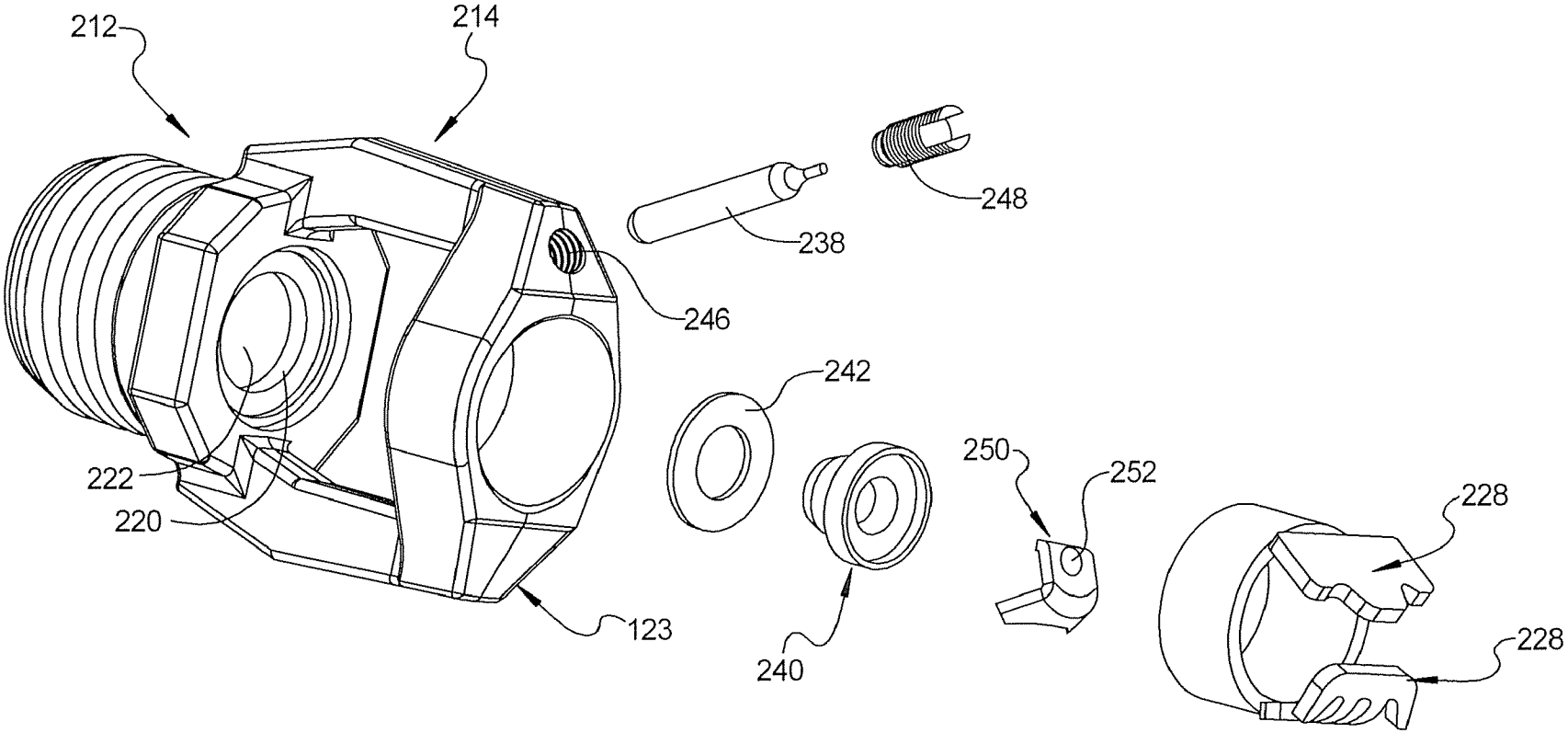
FIG. 9 is an exploded perspective view of the sprinkler assembly of FIG. 8.
Figure 10:
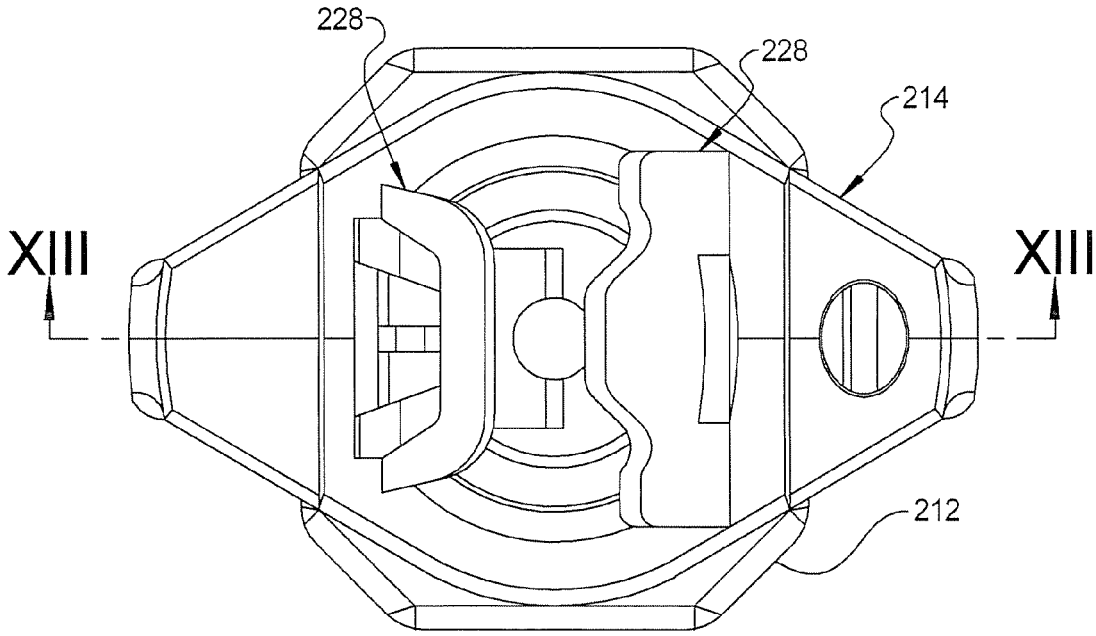
FIG. 10 is a plan view of the sprinkler head of FIG. 8.
Figure 11:
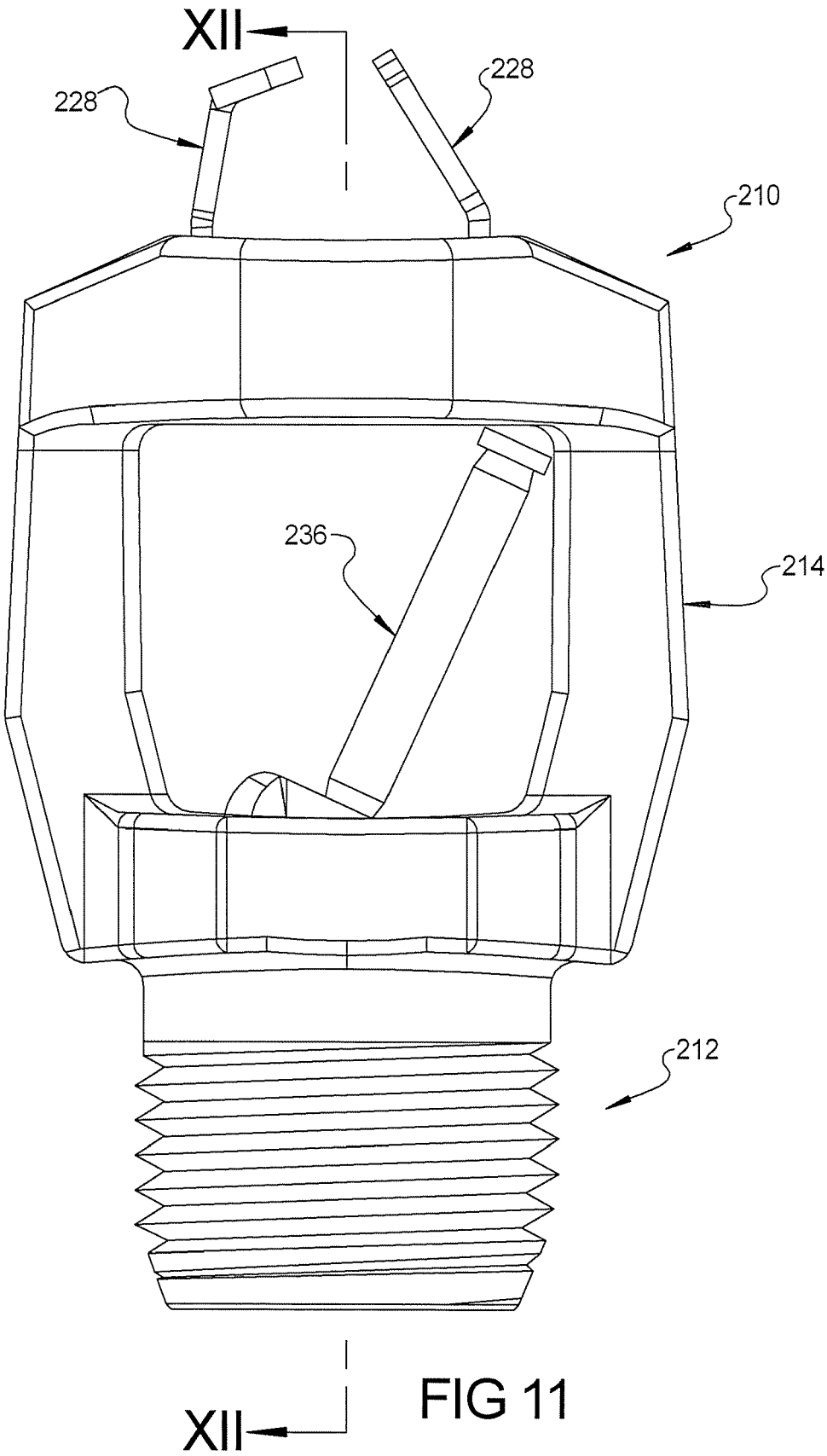
FIG. 11 is a side elevation view of the sprinkler assembly of FIG. 8.
Figure 12:
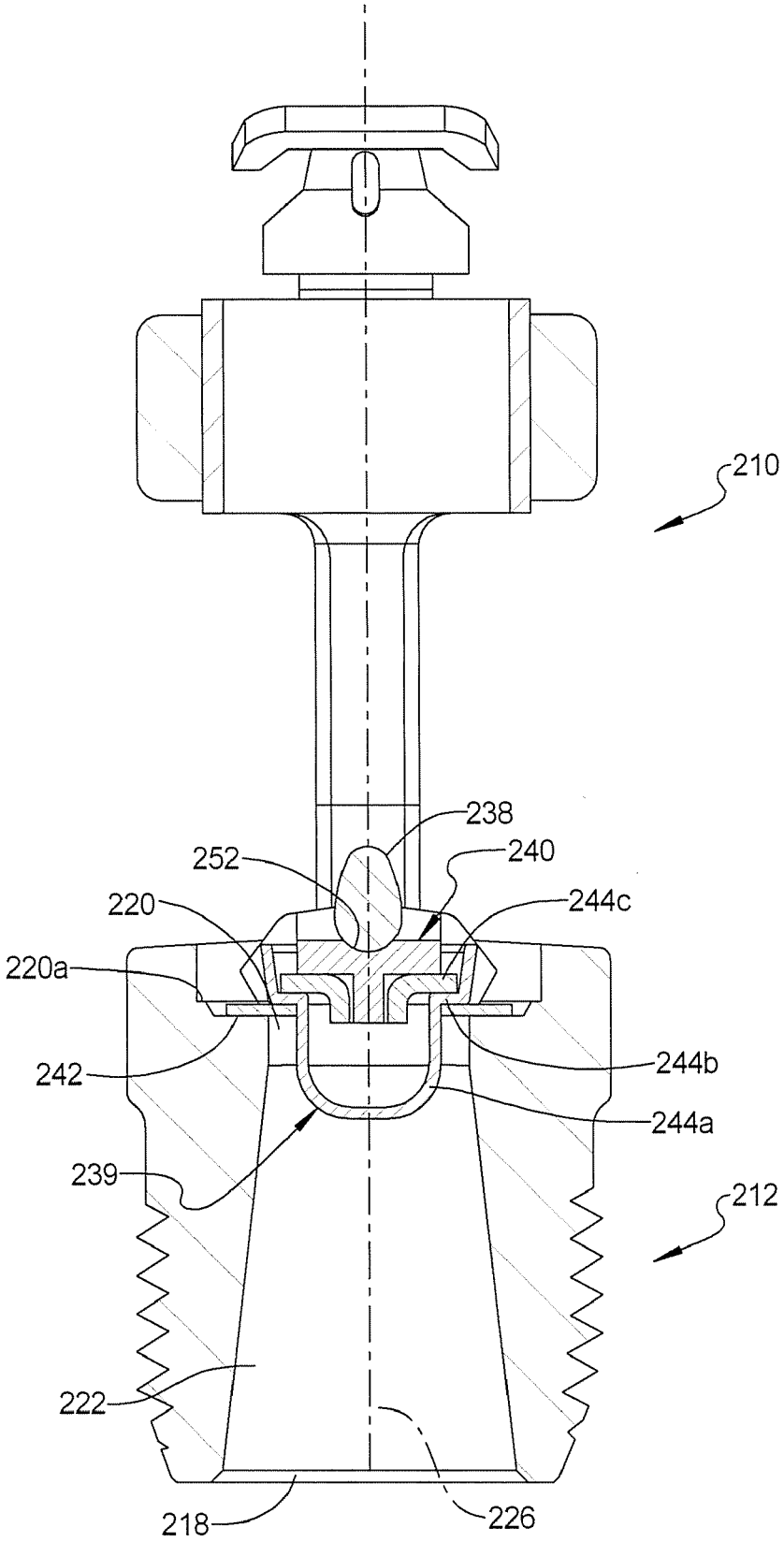
FIG. 12 is a cross-sectional view taken along line XII-XII of FIG. 11.
Figure 13:
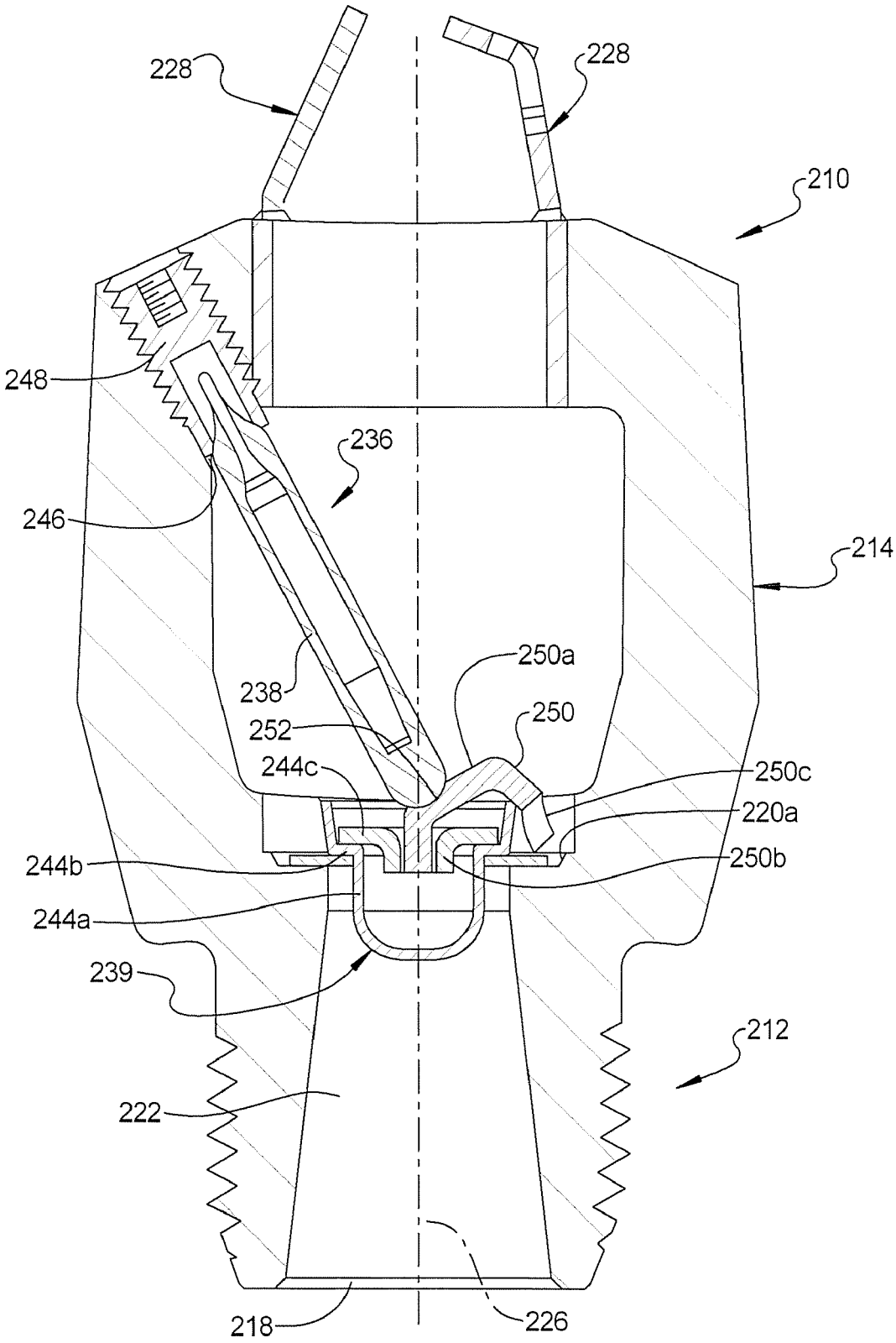
FIG. 13 is a cross-sectional view taken along line XIII-XIII of FIG. 10.

Trigger 236 includes a heat sensitive member 238, similar to member 38, which is supported in closure device 239 by trigger support 240, which is seated in discharge opening 220 over an annular spring seal 242 (FIG. 9). As illustrated in FIGS. 12 and 13, trigger support 240 includes a cup shaped body 244*a*, with an annular rim 244*b* that rests on spring seal 242, and an annular seat 244*c* that sits in the seat formed by rim 244*b*. Spring seal 242, which is positioned between trigger support 240 and body 212 about opening 220, urges support 240 outwardly from body 212 when heat sensitive member 238 releases its pressure on support 240 when triggered by a temperature associated with a fire.

Similar to the previous embodiments trigger member 238 comprises a heat responsive element such as a frangible bulb, with the larger end of member 238 supported in trigger support 240 by a bracket 250. Bracket 250 adapts closure device 239 to provide an angled support surface for trigger member 238. In the illustrated embodiment, bracket 250 comprises an inverted generally U-shaped flange 250*a* with three depending arms 250*b*, 250*c*, and 250*d*. Flange 250*a* includes a recess or opening 252 for forming a seat. Arm 250*b* rests on annular seat 244*c* with the other arms (250*c*, 250*d*) straddling rim 244*b* and resting on annular rim 220*a* of body 212, which extends around opening 220. Recess 252 is angled with respect to axis 226 (FIG. 13) so as to provide an angled support or mounting surface for holding the end of member 238. The opposed end of heat sensitive member 238 is received in a recess 246 of frame 214, which is offset from axis 226 to provide a second support or mounting surface similarly angled with respect to axis 226. In this manner, similar to the previous embodiments, member 238 is supported between body 212 and frame 214 on mounting surfaces that are both angled with respect to axis 226 of sprinkler assembly 210 so that trigger member 238 is angled offset from axis 226. Therefore, it should be understood that bracket 250 or a similar bracket may be used to retrofit an existing conventional sprinkler to hold an offset trigger, provided the frame is provided with an offset socket for receiving the other end of the trigger.

Figure 14:
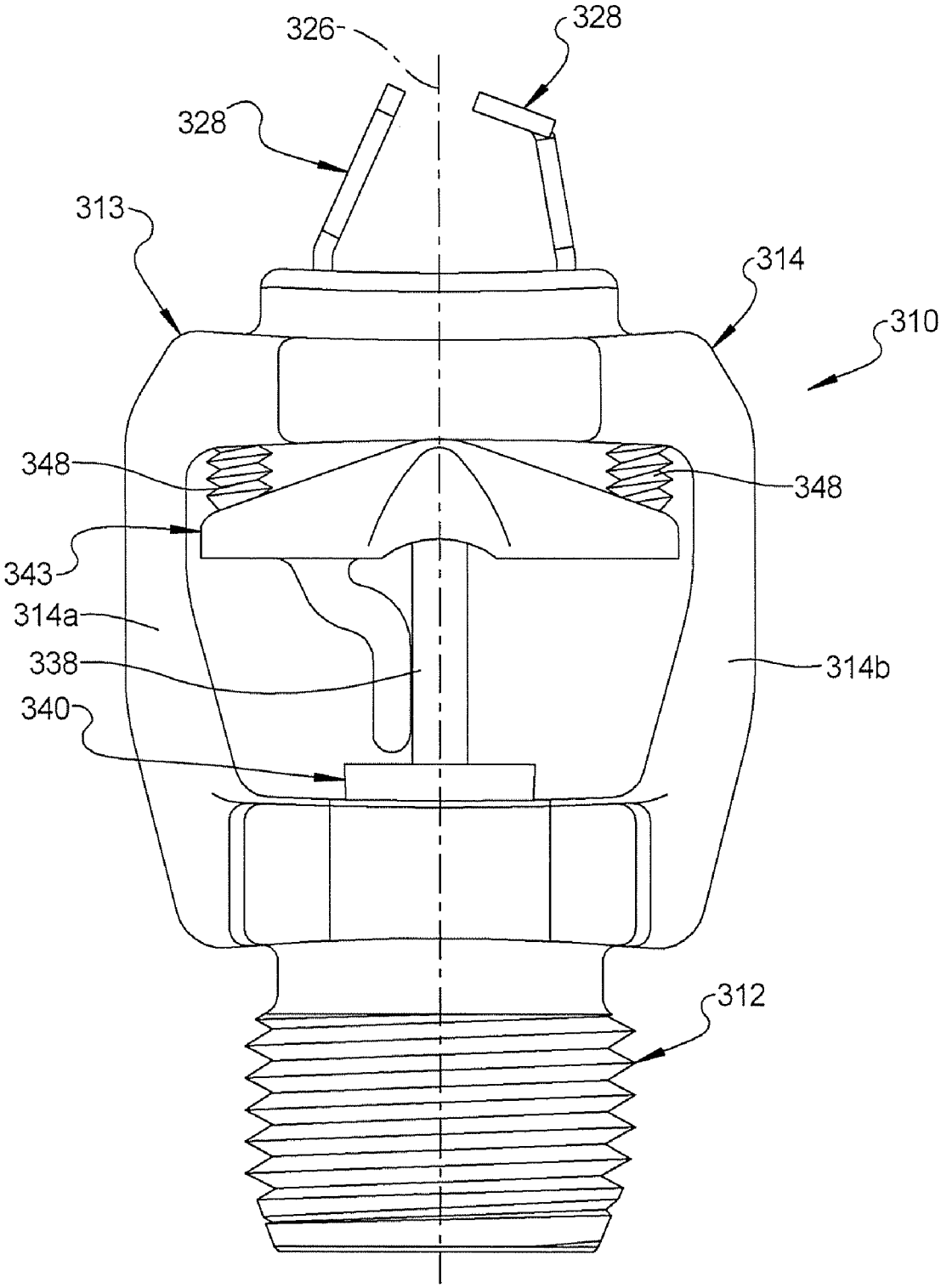
FIG. 14 is a side view of another embodiment of the sprinkler assembly of the present disclosure.
Figure 14A:
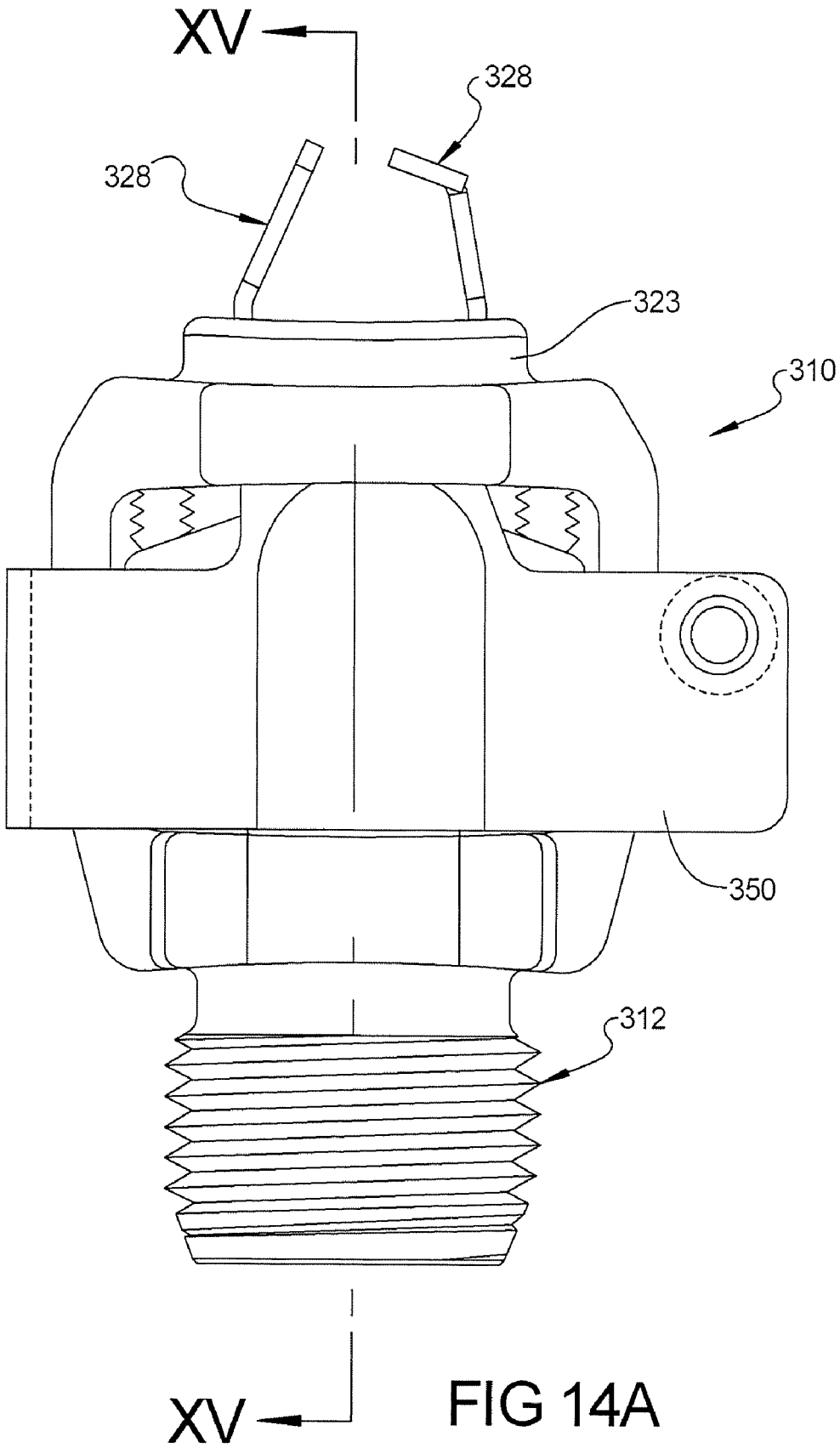
FIG. 14A is a side view of the sprinkler assembly of FIG. 14 with a removable cover installed for shipping and handling purposes.
Figure 15:
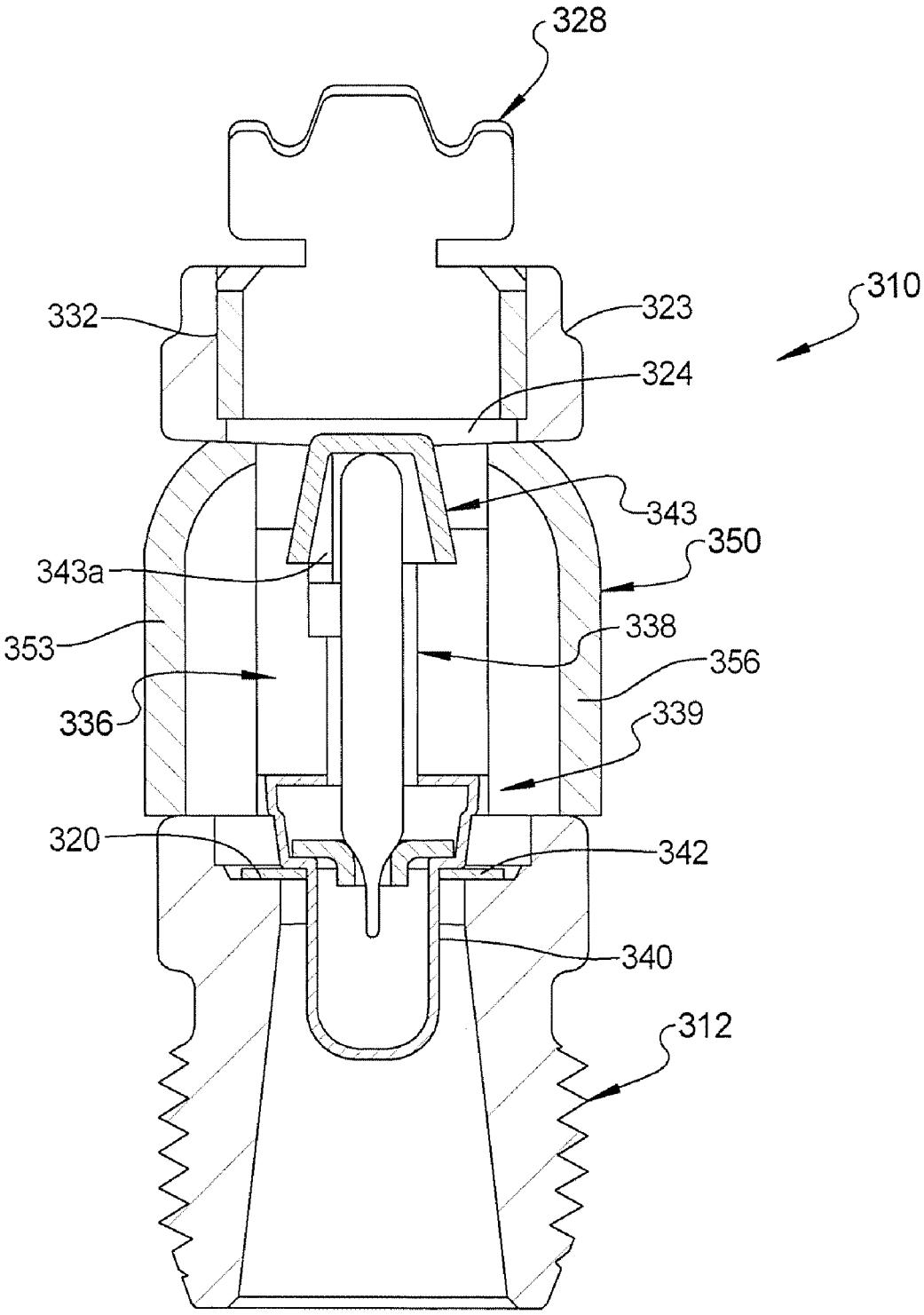
FIG. 15 is a cross-section taken along line XV-XV of FIG. 14.
Figure 15A:
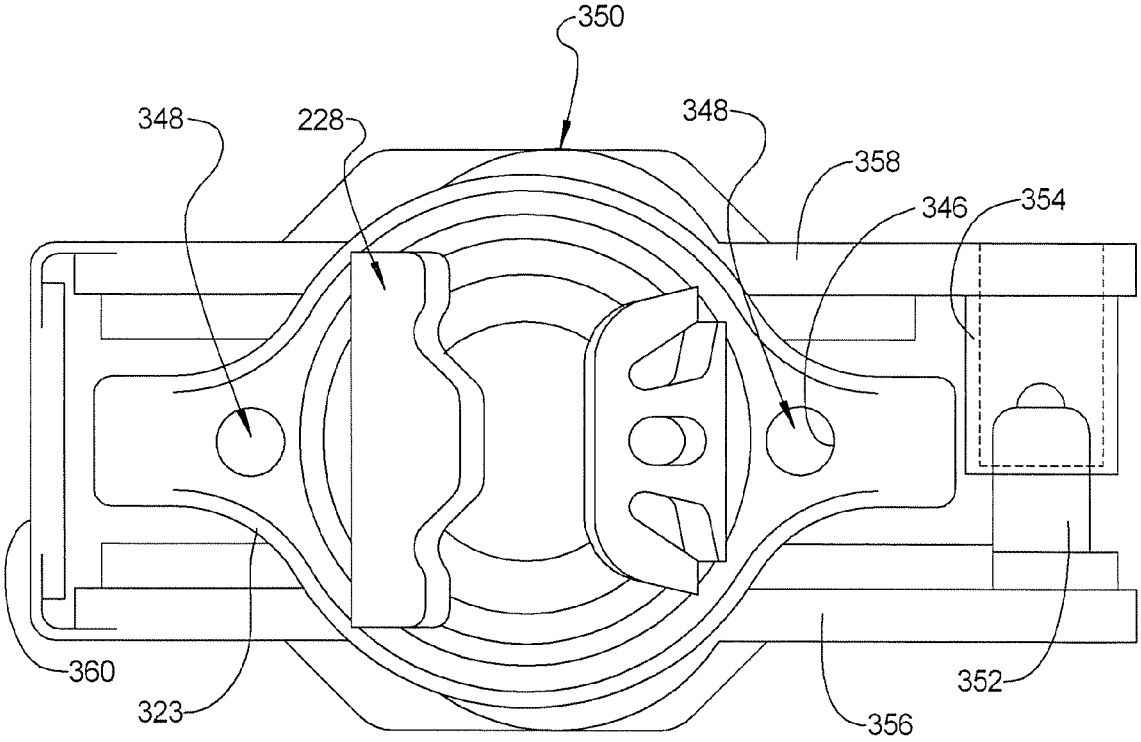
FIG. 15A is a top plan view of the sprinkler assembly of FIG. 14A.
Figure 16:
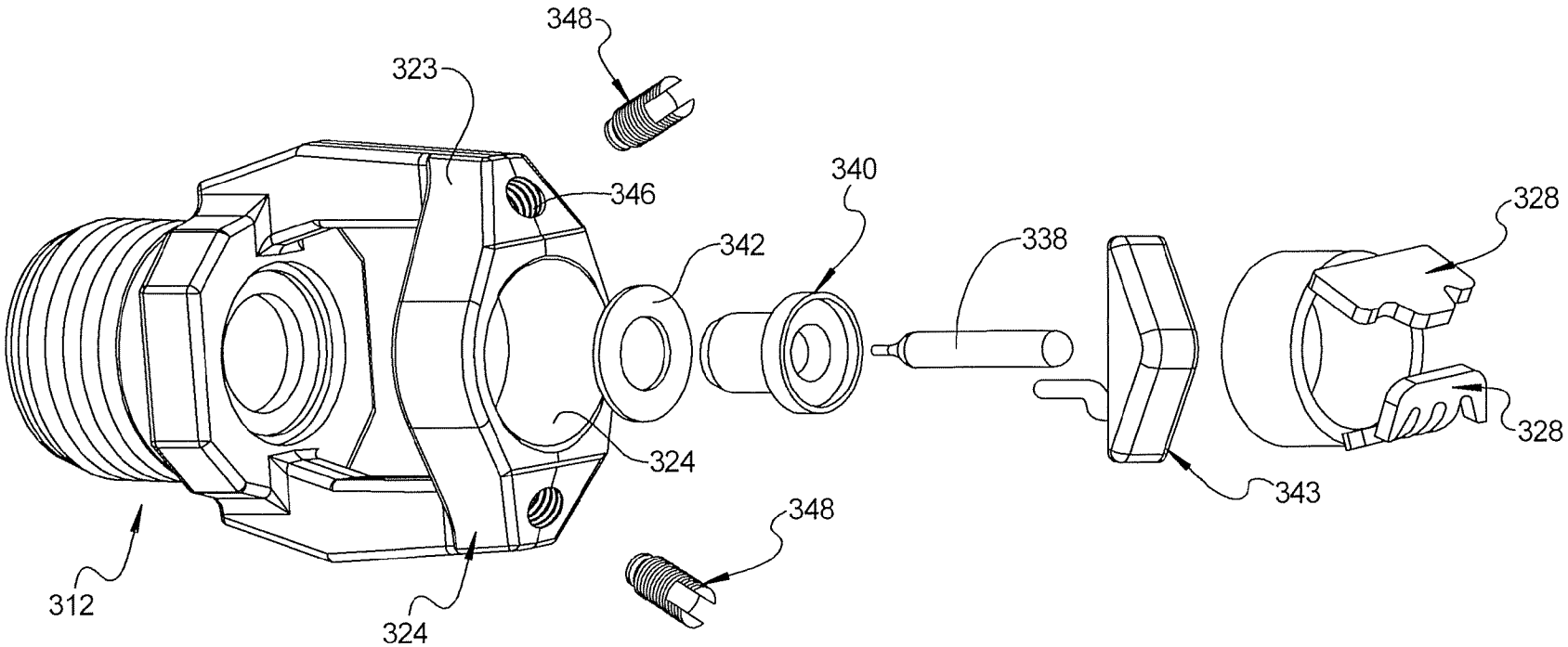
FIG. 16 is an exploded perspective view of the sprinkler assembly of FIG. 14.

Referring to FIGS. 14-16, the numeral 310 generally designates a fourth embodiment of the sprinkler assembly of the present invention, which is similar to sprinkler assemblies 110 and 210 with a modified trigger 336. Therefore, for the details of body 312, and support 313 (and frame 314), reference is made to bodies 112, 212, and supports 113, 213.

In the illustrated embodiment, trigger 336 includes a heat sensitive member 338, which in the illustrated embodiment comprises a frangible bulb that is generally aligned along axis 326 of sprinkler assembly 310. It should be understood that member 338, like members 38, 138, and 238, may be formed from a fused link, such as described in U.S. Pat. No. 6,918,545 which is herein incorporated by reference in its entirety. Heat sensitive member 338 is supported on one end on closure device 339 by a heat sensitive member support 340, which is similar to support 240 except that it supports the narrower end of heat sensitive member 338 in opening 320 of body 312. In addition, an annular spring seal 342 (FIG. 16) of closure device 339 is positioned between support 340 and body 312 about opening 320, which urges support 340 outwardly from body 312 when heat sensitive member 338 releases pressure on support 340 when triggered by a temperature associated with a fire. The other, larger end of heat sensitive member 338 is mounted to frame 314 by a transverse compression member, such as yoke 343.

Figures 16A, 16B, 16C, 16D, 16E:
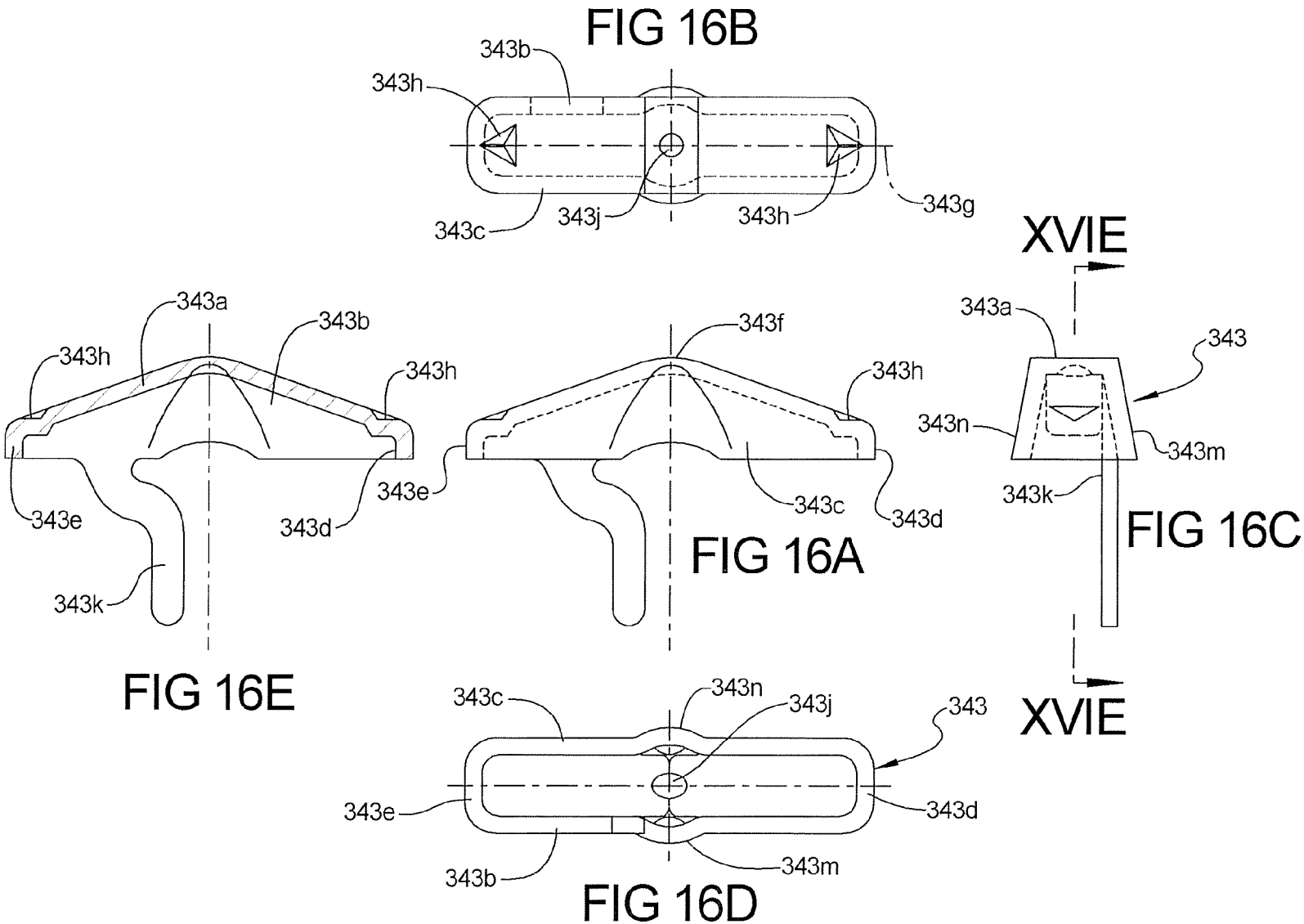
FIG. 16A is an enlarged side view of the transverse compression member of FIG. 14.
FIG. 16B is a top plan view of the compression member of FIG. 16A.
FIG. 16C is an end view of the compression member of FIG. 16A.
FIG. 16D is a bottom plan view of the compression member of FIG. 16A.
FIG. 16E is a cross-section taken long line XVIE-XVIE of FIG. 16C.

Yoke 343 extends between arms 314*a* and 314*b* below transverse member 323 and comprises a hollow wedge-shaped member with a slotted recess 343*a* for holding the larger end of heat sensitive member 338 therein. Yoke 343 is supported in position by heat sensitive member 338 and two compression screws or fasteners 348 that extend through transverse recesses or openings 346 provided in transverse member 323 to thereby compress yoke 343 against trigger member 338. The fasteners 348 can be disposed generally parallel to the axis 326 of the body 312, as shown in FIG. 14 or can be angularly disposed relative thereto as shown in FIG. 16. In the illustrated embodiment, the hollow wedge-shaped compression member includes an upper wall 343*a* and a pair of spaced apart side walls 343*b*, 343*c* and a pair of end walls 343*d*, 343*e*. Upper wall 343*a* is generally an inverted V-shape wall with an apex 343*f*, which is generally centrally located between end walls 343*d*, 343*e*. The angled portions of wall 343*a* may form an angle from horizontal (with reference to FIG. 16A) in a range of 15° to 30° and, more preferably, about 20°. Located along the longitudinal central axis 343*g* of yoke 343 and at apex 343*f* is an opening 343*j* which is aligned with a recess in the underside of wall 343*a* to form a seat for the upper end of heat sensitive member 338. Upper wall 343*a* also includes a pair of recesses 343*h* for receiving the ends of compression screws 348. Optionally, yoke 343 includes a downwardly depending arm 343*k*, which facilitates the ejection of support 340 from the sprinkler when the heat sensitive member is triggered. In the illustrated embodiment, arm 343*k* extends downwardly from side wall 343*b* and provides a pivot point for support 340 so that when support is ejected from discharge opening 320, support 340 and the compression member contact but then pivot and eject outwardly from the sprinkler.

As would be understood, yoke 343, therefore, forms a bridge to support the larger end of heat sensitive member 338 at a distance spaced inwardly from transverse member 323 of frame 314. When compressed and not subject to significant lateral forces, yoke 343 and heat sensitive member 338 are stable and will remain aligned between frame 314 and body 312. However, once heat sensitive member 338 is exposed to a temperature associated with a fire and heat sensitive member 338 no longer maintains its structural integrity, yoke 343 will no longer be stable and will fall away from frame 314 along with the remnants of heat sensitive member 338 and support 340, as would be understood by those skilled in the art. In addition, side walls 343*b*, 343*c* include flared central portions 343*m*, 343*n* to increase the instability of yoke 343 when heat sensitive member 338 is exposed to a heat sufficient to cause member 338 to break.

Figure 16H:
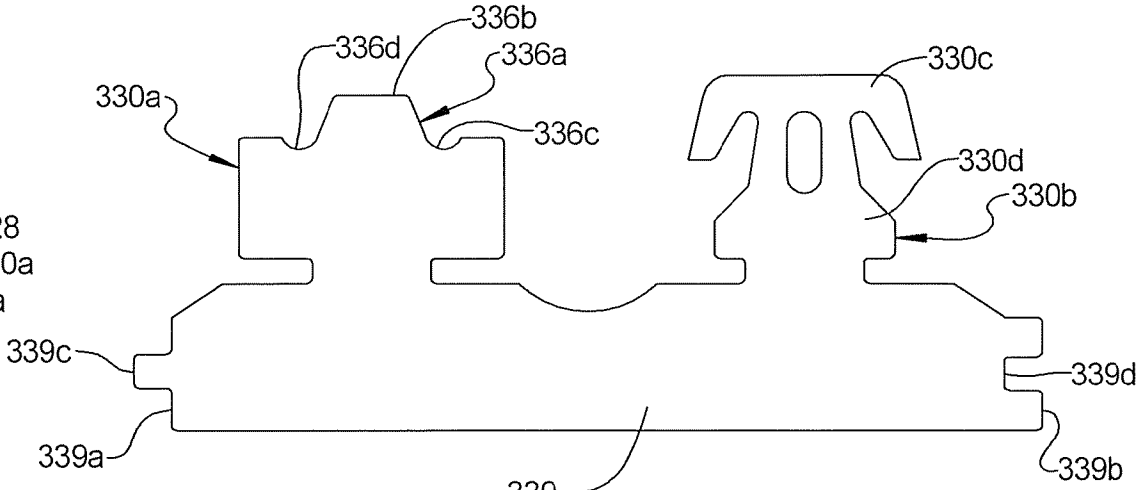
FIG. 16H is a plan view of a blank for forming the flow-shaper members of FIG. 16F.
Figure 16F:
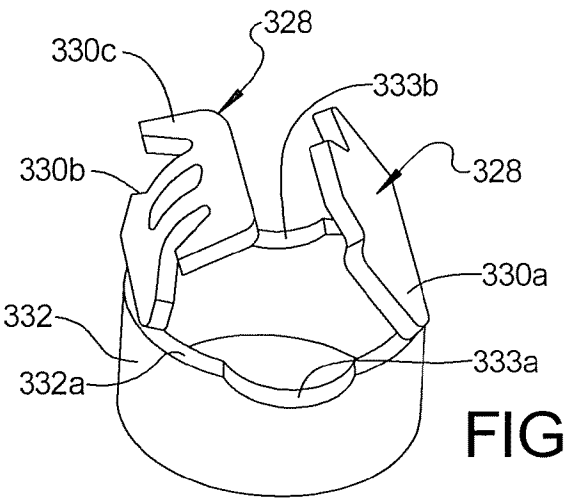
FIG. 16F is a perspective view of the flow-shaper members of the sprinkler assembly of FIG. 14.
Figure 16G:
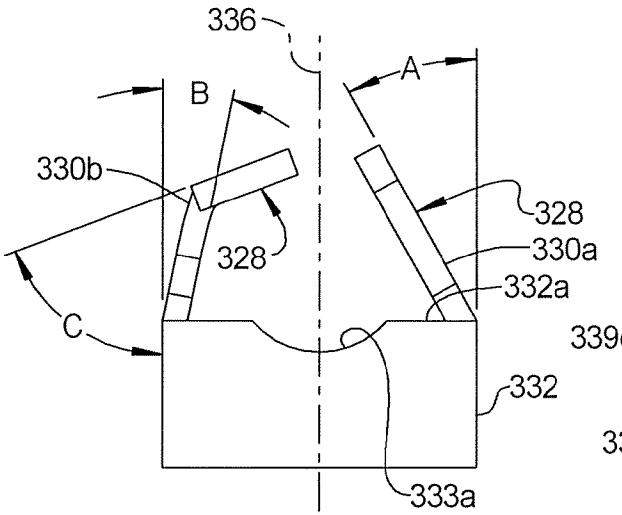
FIG. 16G is a side view of the flow-shaper members of FIG. 16F.

Referring to FIGS. 16F-16H, flow-shaper members 328 are of similar construction to flow-shaper members 128. For example, flow-shaper members 328 are provided by tabs 330*a*, 330*b*, which are formed or otherwise provided on an annular member 332. In addition, as best seen in FIG. 16G, like tab 30*a*, tab 330*a* may be angled at an angle A from a line parallel to a central axis 336 of annular member 332 in a range, for example, of 10° to 60° and, more typically, in a range of 20° to 40°, similar to the previous embodiments. Similarly, tab 330*b* may be angled at an angle B with respect to a line parallel to axis 336 in a range of 0° to 40° and, more typically, in a range of 10° to 20°, also similar to the previous embodiments.

Tab 330*b* also includes an enlarged inverted U-shaped portion 330*c* at its outer end, which when formed is angled relative to the base portion 330*d* of tab 330*b*. Further, as best seen in FIG. 16G, portion 330*c* may be angled with respect to the same line as tab 330*b* at an angle C in a range of 30° to 90° and, more typically, in a range of 50° to 70°.

As best seen in FIG. 16H, flow-shaper members 328 may be formed with an annular member 332 as a blank 339, with opposed ends 339*a* and 339*b* of blank 339 including interlocking features, such as a tab 339*c* and a recess 339*d*. In addition, annular member 332 may be provided with arcuate indentations or cut-outs 333*a*, 333*b* at its upper edge 332*a*. However, it should be understood that sprinkler assembly 310 may alternately incorporate flow-shaper members 28, described in reference to the first embodiment.

Figure 17:
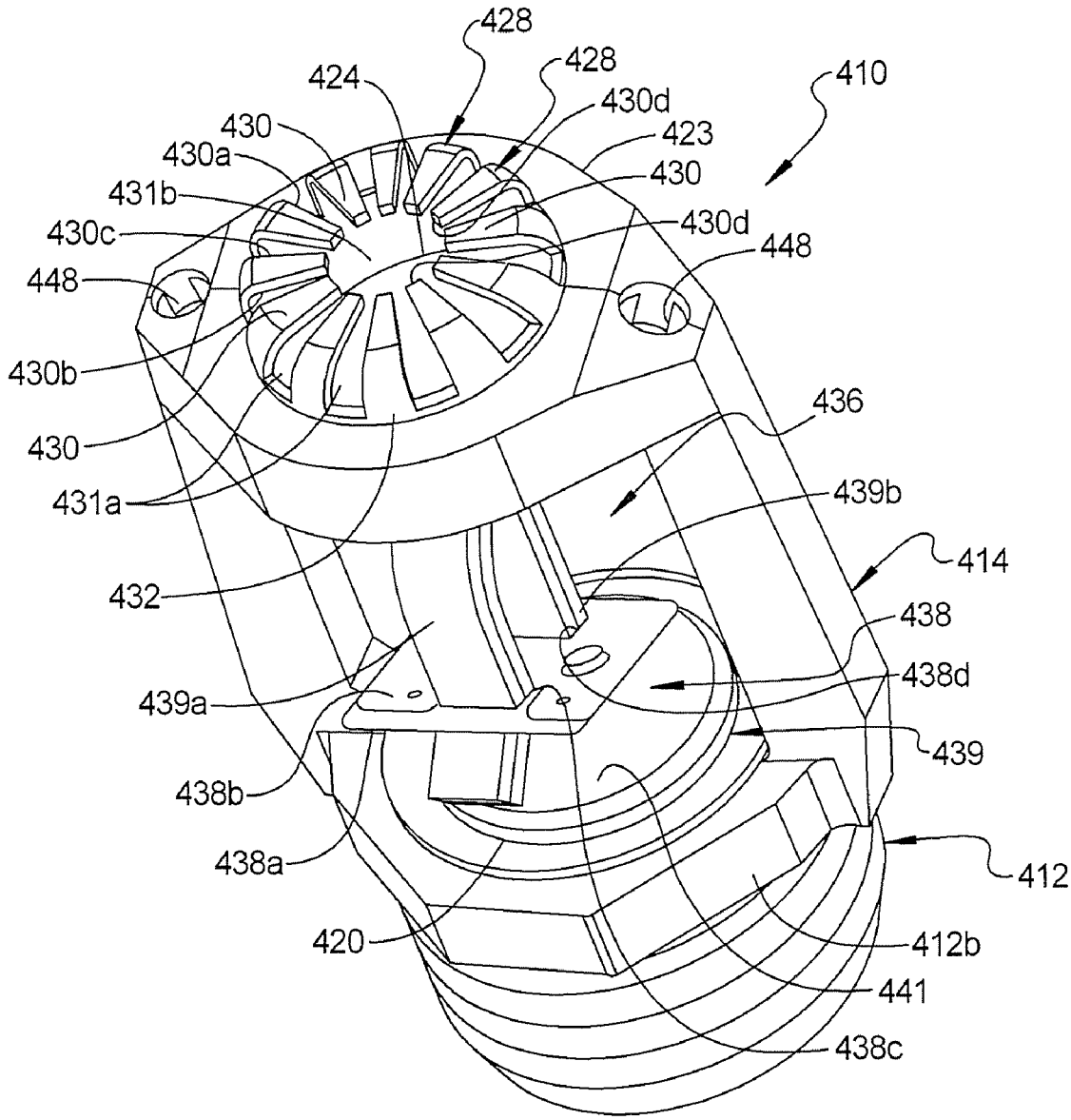
FIG. 17 is a perspective view of a fifth embodiment of the sprinkler assembly of the present disclosure.
Figure 18:
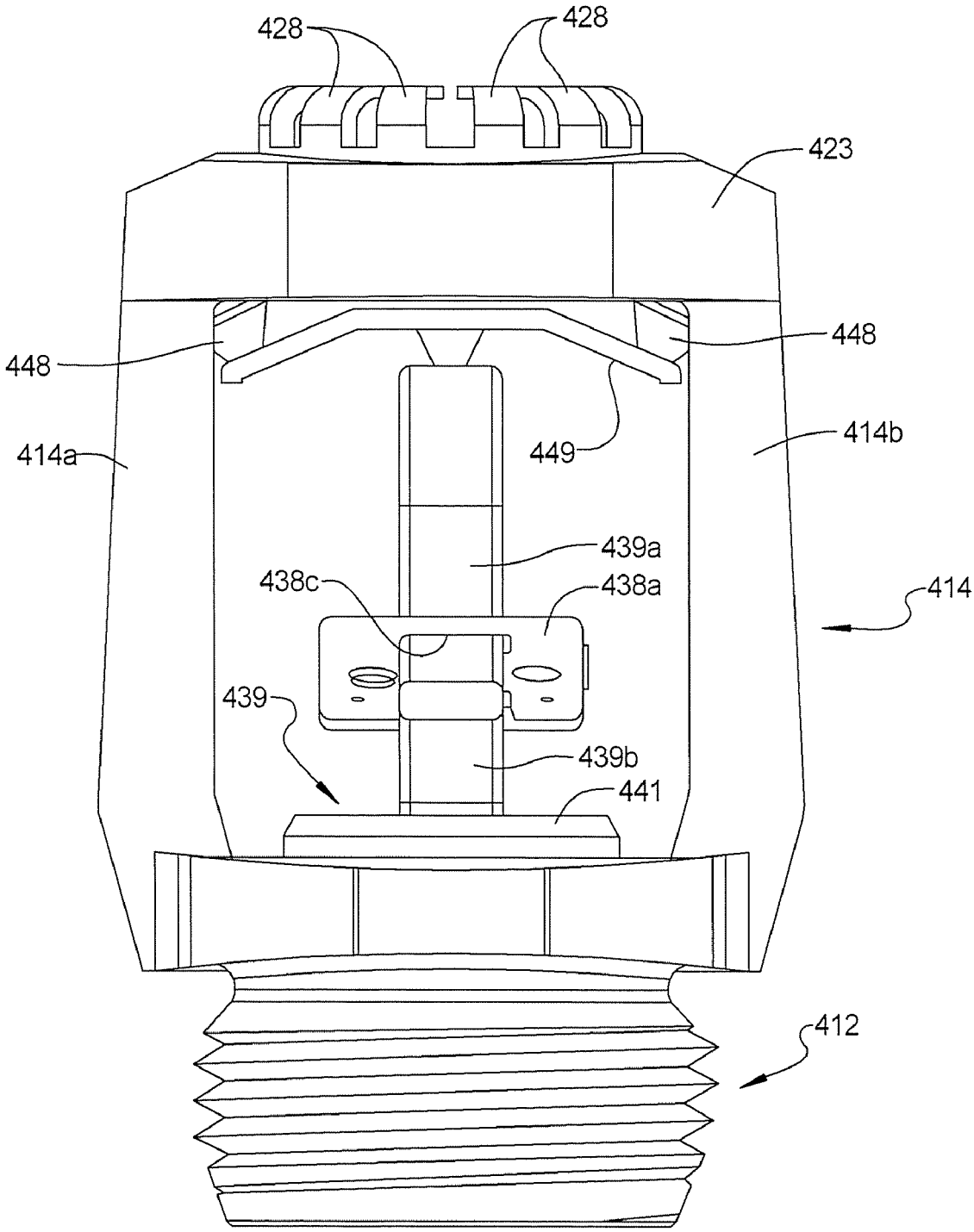
FIG. 18 is a side elevation view of the sprinkler assembly of FIG. 17.
Figure 19:
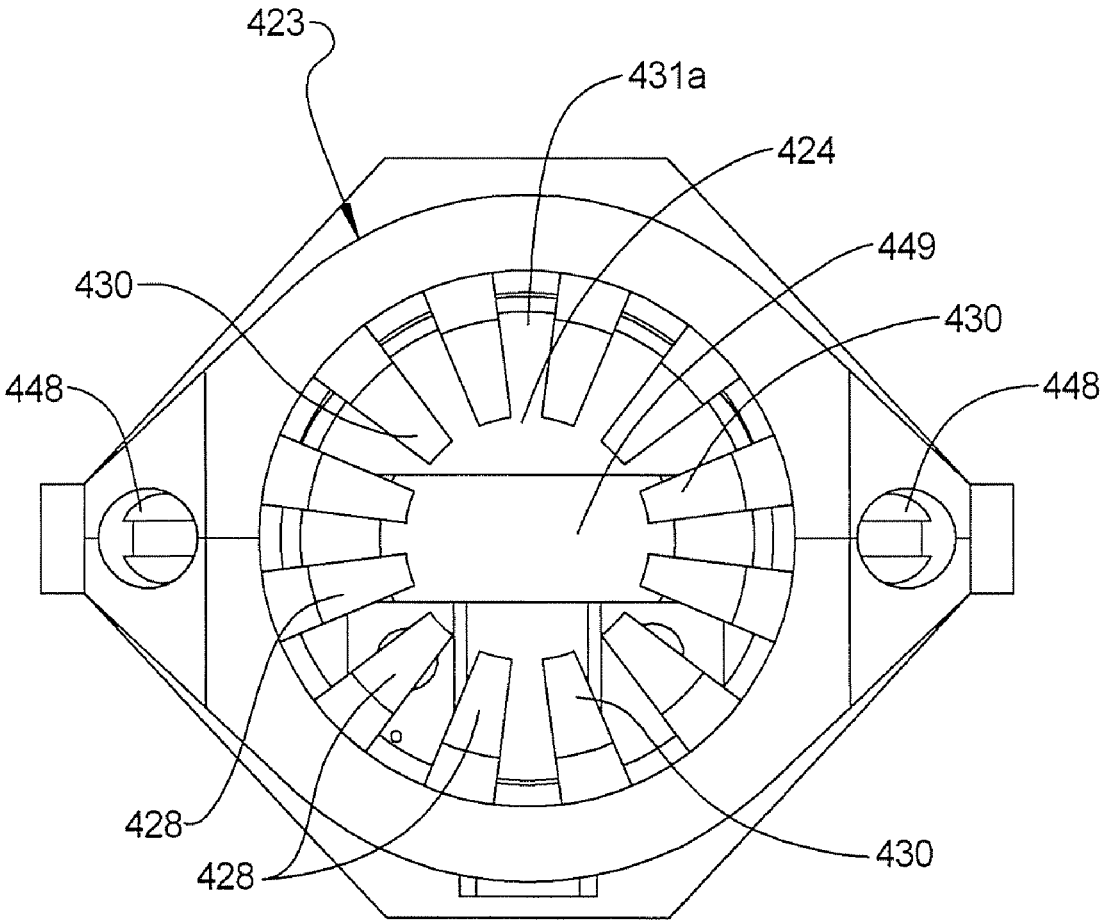
FIG. 19 is a top plan view of the sprinkler assembly of FIG. 18.
Figure 19A:
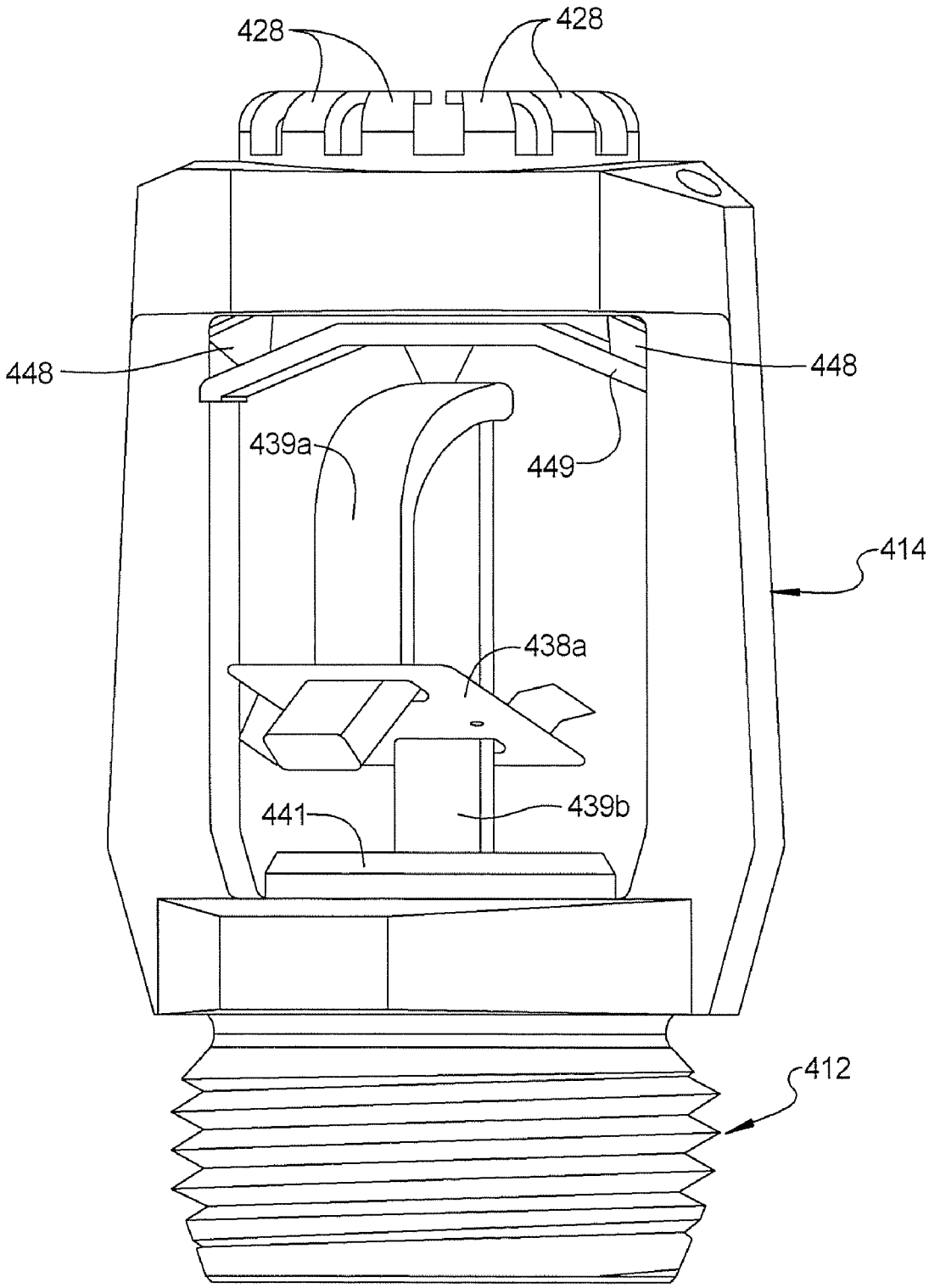
FIG. 19A is another side elevation view of the sprinkler assembly of FIG. 18.
Figure 20:
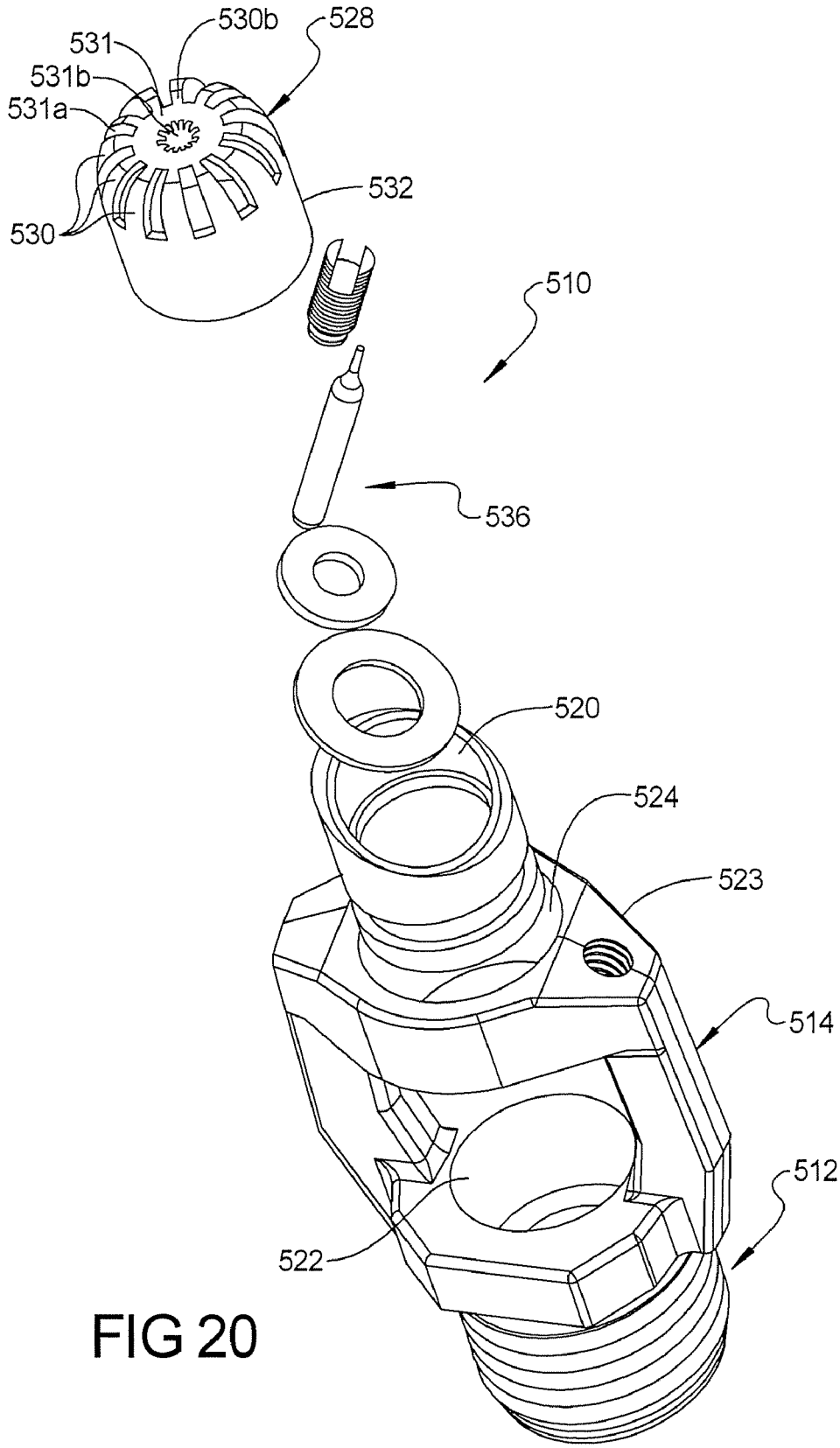
FIG. 20 is an exploded perspective view of a sixth embodiment of the sprinkler assembly of the present disclosure.
Figure 21:
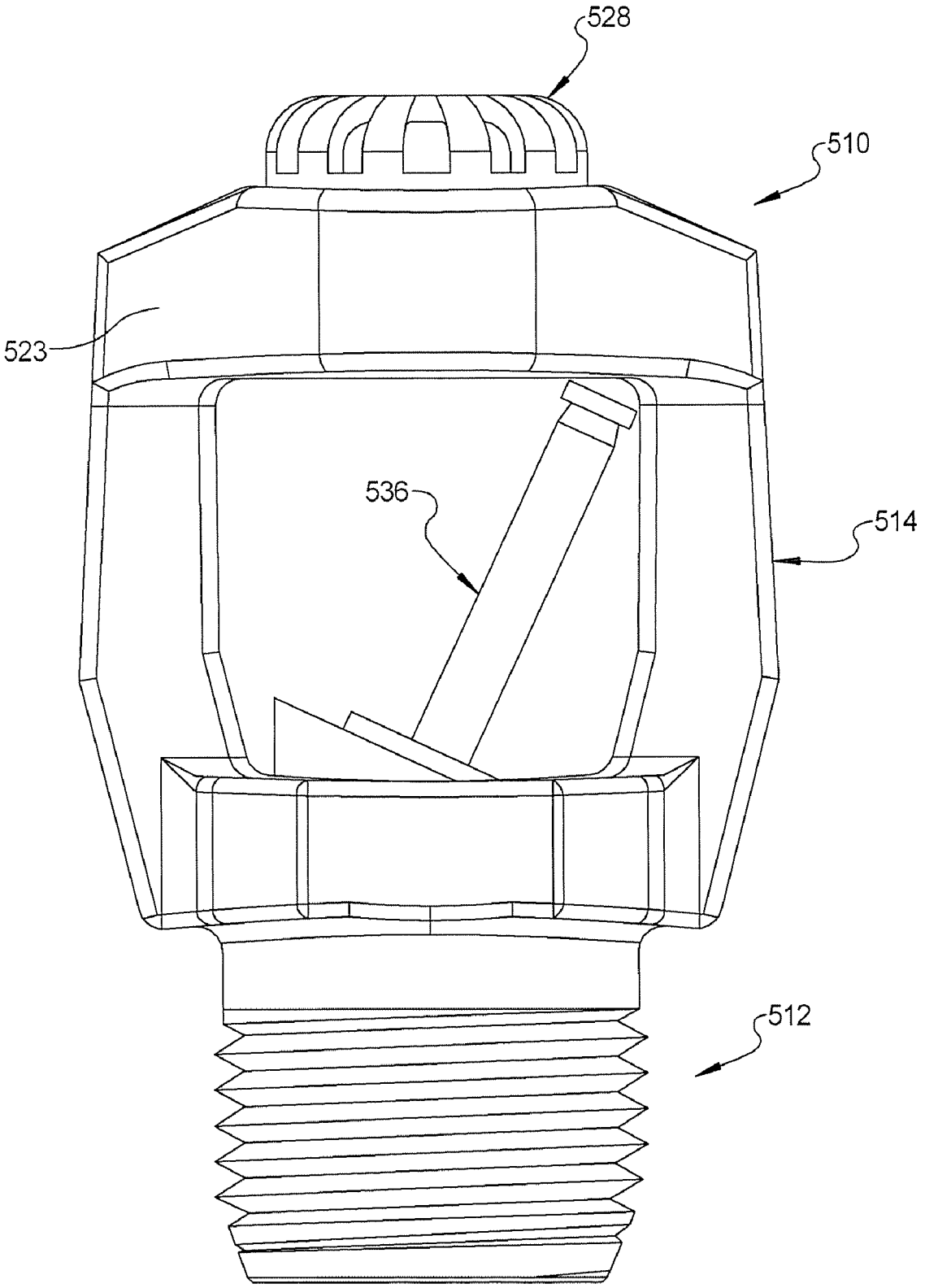
FIG. 21 is a side view of the sprinkler assembly of FIG. 20 shown in an assembled condition.
Figure 22:
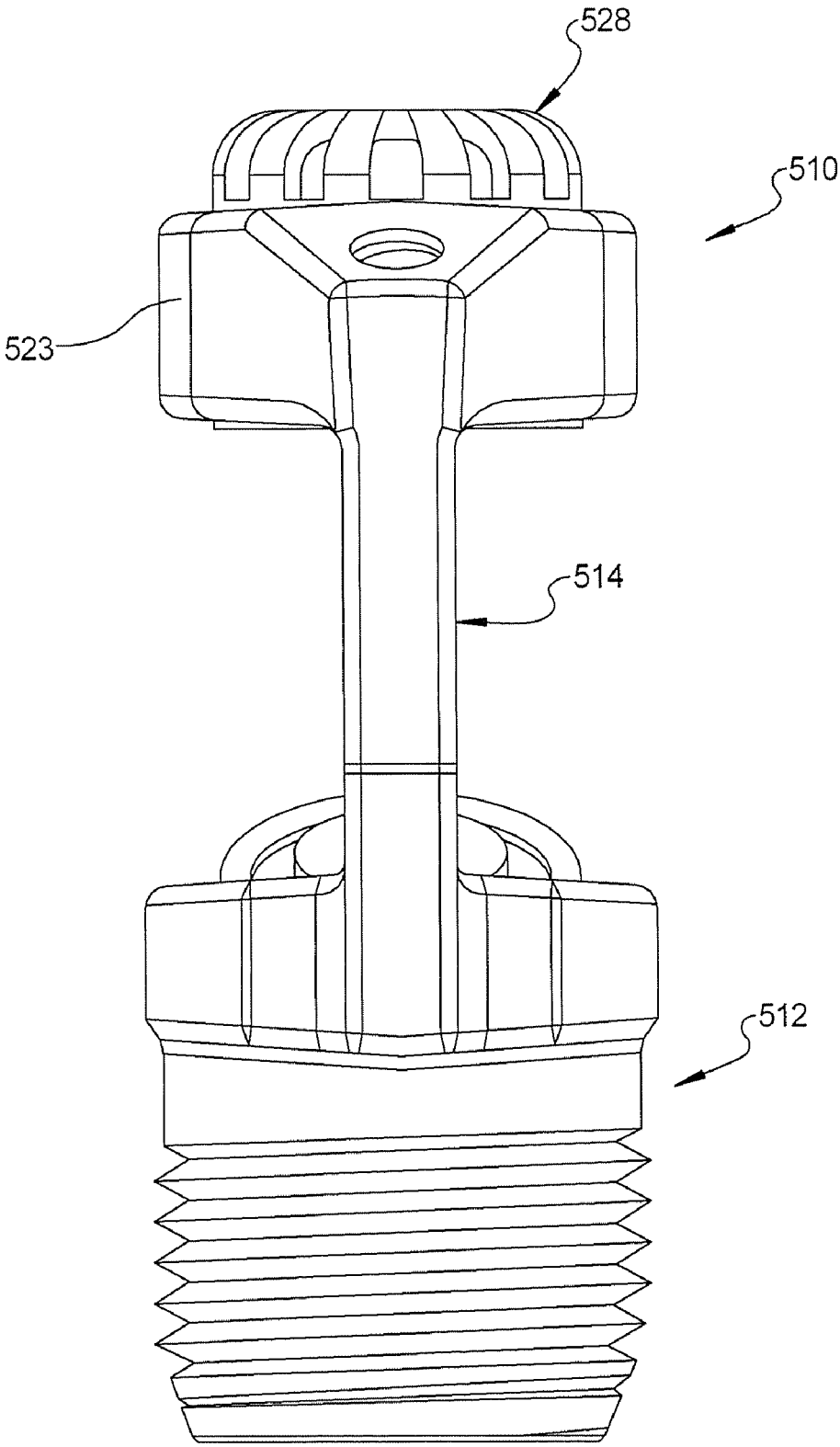
FIG. 22 is a second side view of the sprinkler assembly of FIG. 21.

Referring to FIGS. 17-19, the numeral 410 generally designates a fifth embodiment of the sprinkler assembly of the present disclosure. In the illustrated embodiment, sprinkler assembly 410 comprises a pendent sprinkler assembly but incorporates a generally similar body 412, frame 414, and closure device 439 to the bodies, frames, and closure devices of sprinkler assemblies 110, 210, and 310 but incorporates a modified trigger 436 and flow-shaper members 428. For the general details of frame 414, body 412, and closure device 439, therefore, reference is made to frames 114, 214, and 314, bodies 112, 212, and 312, and closure devices 139, 239, and 339, though it should be noted that base flange 412*b* and transverse member 423 have a modified shape to provide a more robust body and frame.

In the illustrated embodiment, flow-shaper members 428 are formed by a plurality of fingers or tines 430 that are mounted or formed on an annular member 432, which together form a flow-shaper. Similar to the previous embodiments, annular member 432 is positioned in opening 424 of transverse member 423. Each tine 430 includes a first portion that extends outwardly from annular member 432 (in a direction away from opening 424) and a second portion bent or rolled radially inward toward axis 426 and, further, in a manner so that the end portions 430*a* of tines 430 generally lie in a common plane spaced from opening 424. In addition, each tine 430 includes tapered side edges 430*b*, 430*c* so that when the second portions of tines 430 are bent or rolled toward axis 426, tines 430 are spaced apart to form radially arranged spaces or passageways 431*a* through which the fluid flowing from discharge opening 420 and through opening 424 can flow. Further, the distal ends 430*d* of tines 430 are spaced apart so that they are offset from axis 426 and form a central, circular opening 431*b* there between, in to which passageways 431*a* open. In this manner flow-shaper members 428, like the flow-shaper members of the previous embodiments, are offset from axis 426 and do not redirect the flow of the fluid, and instead allow the fluid to flow between the flow-shaper members to reduce the friction loss and, further, operate on the column of fluid radially inward from the outer surface of the column of fluid. In the illustrated embodiment tines 430 are trapezoidal in shape and are evenly spaced around opening 431*b* and, further, generally have the same lengths. Alternately, tines 430 may be rectangular or triangular in shape and/or have different lengths. In addition, tines 430 may be spaced around opening in a non-uniform arrangement.

Trigger 436 includes a heat sensitive member 438 in the form of a fuse plate assembly, which is formed from two plates 438*a* and 438*b* that are fused together by a fusible material, which generally liquefies or melts upon exposure to a temperature associated with a fire. Plates 438*a* and 438*b* are biased against the retention force of the fusible material by a pair of lever arms 439*a* and 439*b*, which urge the plates outwardly from the sprinkler assembly when the fusible material melts. For further details of trigger 436, reference is made herein to U.S. Pat. No. 6,152,236, which is incorporated by reference herein in its entirety.

Similar to trigger member 338 of trigger 336, lever arms 439*a* and 439*b* are held in position by a transverse compression member 449, which forms a bridge and supports the ends of the lever arms inwardly from transverse member 423 between frame arms 414*a* and 414*b*. Member 449 is similarly compressed against lever arms 439*a* and 439*b* by compression screws or fasteners 448. In the illustrated embodiment, lever arm 439*a* comprises a generally S-shaped arm, with its upper portion urged into contact with transverse compression member 449 by arm 439*b*, which comprises a generally linear member. The lower portion of each arm is extended through respective opening 438*d* and 438*e* formed between plates 438*a* and 438*b* and apply outward lateral forces on the respective plates 438*a* and 438*b*. In this manner, when the fusible material melts, plates 438*a* and 438*b* are urged outwardly by arms 439*a* and 439*b*. Further, the lower end of arm 439*b* is compressed against a closure device 439, which is formed by a circular member 441 that covers opening 420 and is sealed against the discharge opening with an annular seal (not shown).

Referring to FIGS. 20-23, the numeral 510 generally designates a sixth embodiment of the sprinkler assembly of the present disclosure. Sprinkler assembly 510 is also a pendent sprinkler and may comprise a residential or a commercial sprinkler and, further, may be configured for use as a suppression sprinkler or a control sprinkler. As can be appreciated from FIG. 20, sprinkler assembly 510 is generally similar to sprinkler assemblies 110, 210, and 310, but includes a closure device 539 and trigger 536 similar to closure device 39 and trigger 36 and, further, includes a modified flow-shaper 528. For the general details of frame 514 and body 512, reference is made to frames 114, 214, and 314, and bodies 112, 212, and 312. For further details of closure device 539 and trigger 538, reference is made to device 39 and trigger 36.

Figure 23:
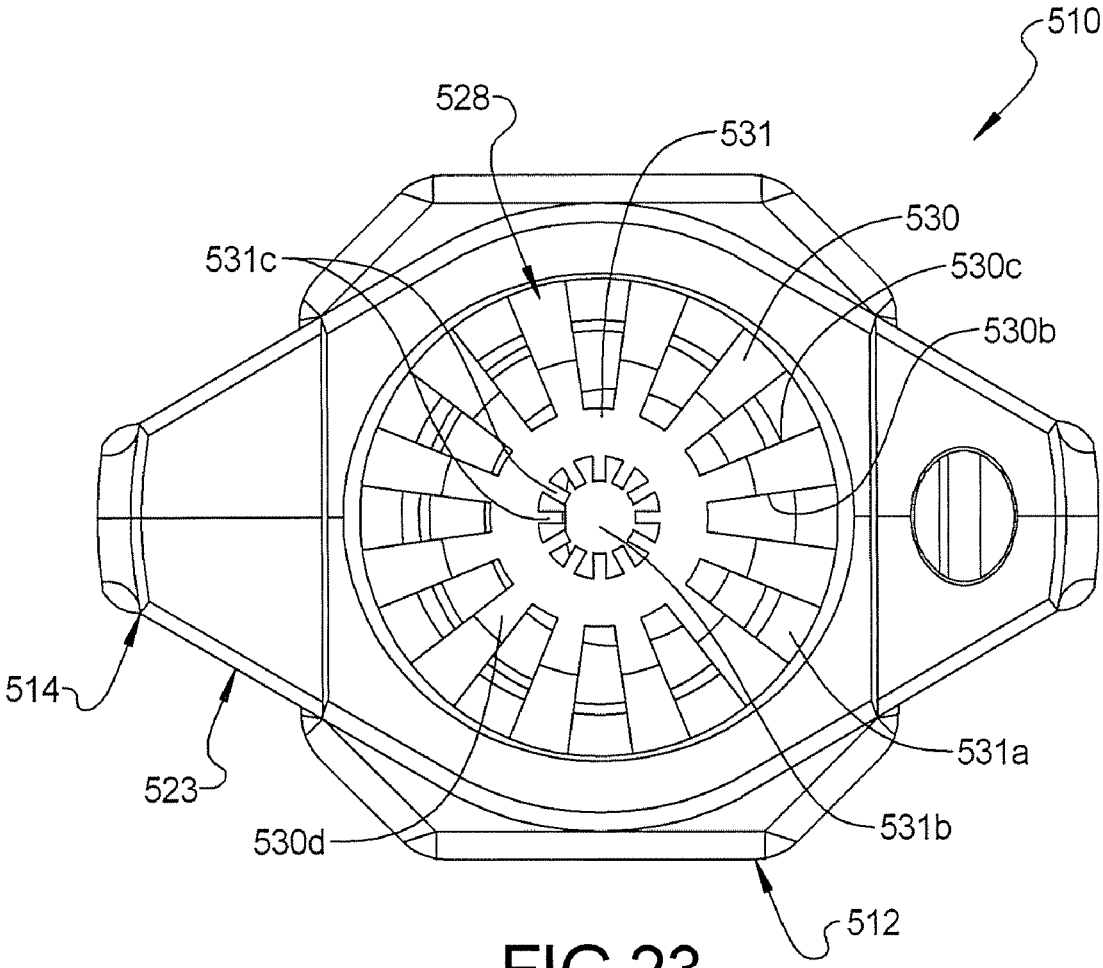
FIG. 23 is a top plan view of the sprinkler assembly of FIG. 22.
Figure 24:
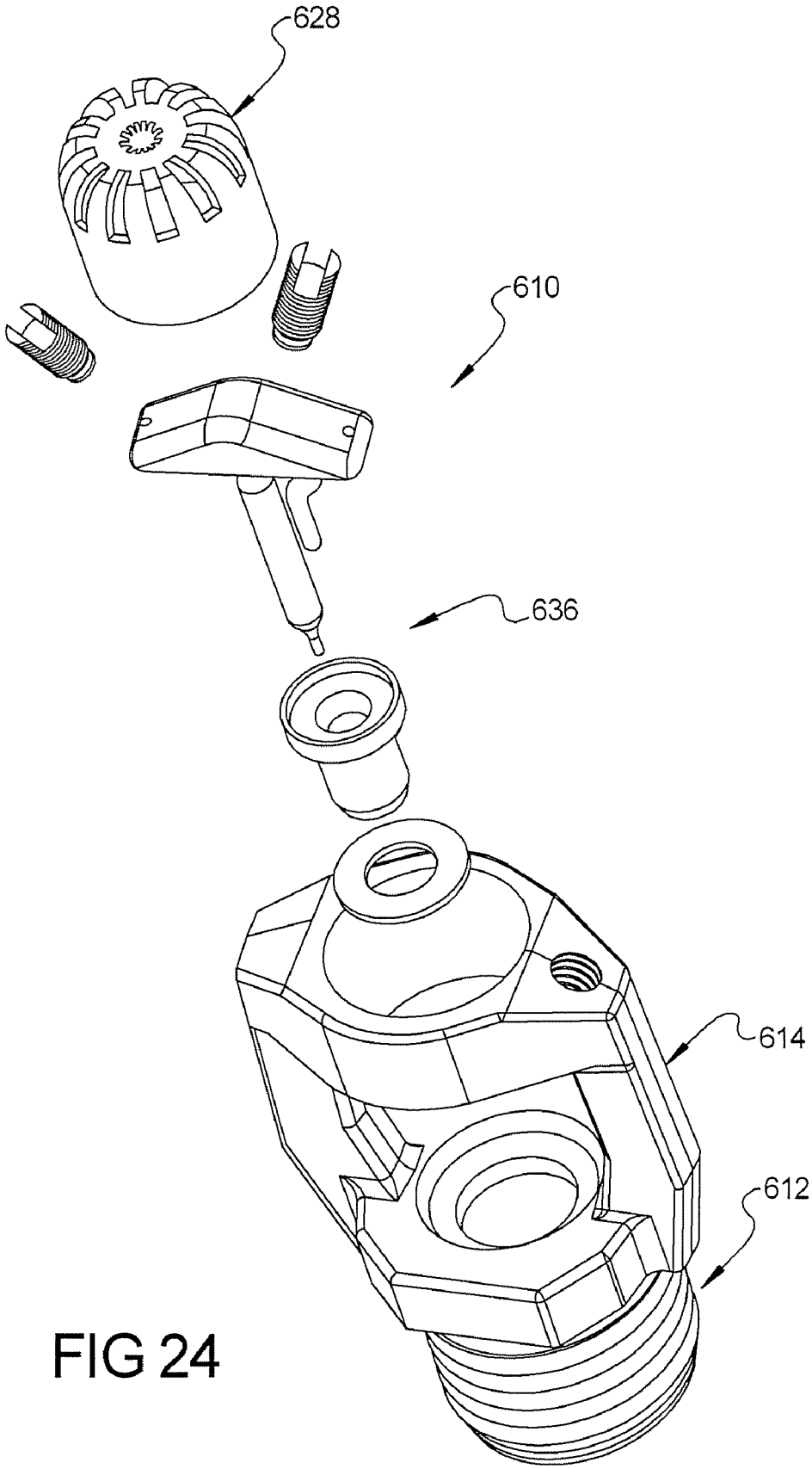
FIG. 24 is an exploded perspective view of a seventh embodiment of the sprinkler assembly of the present disclosure.
Figure 25:
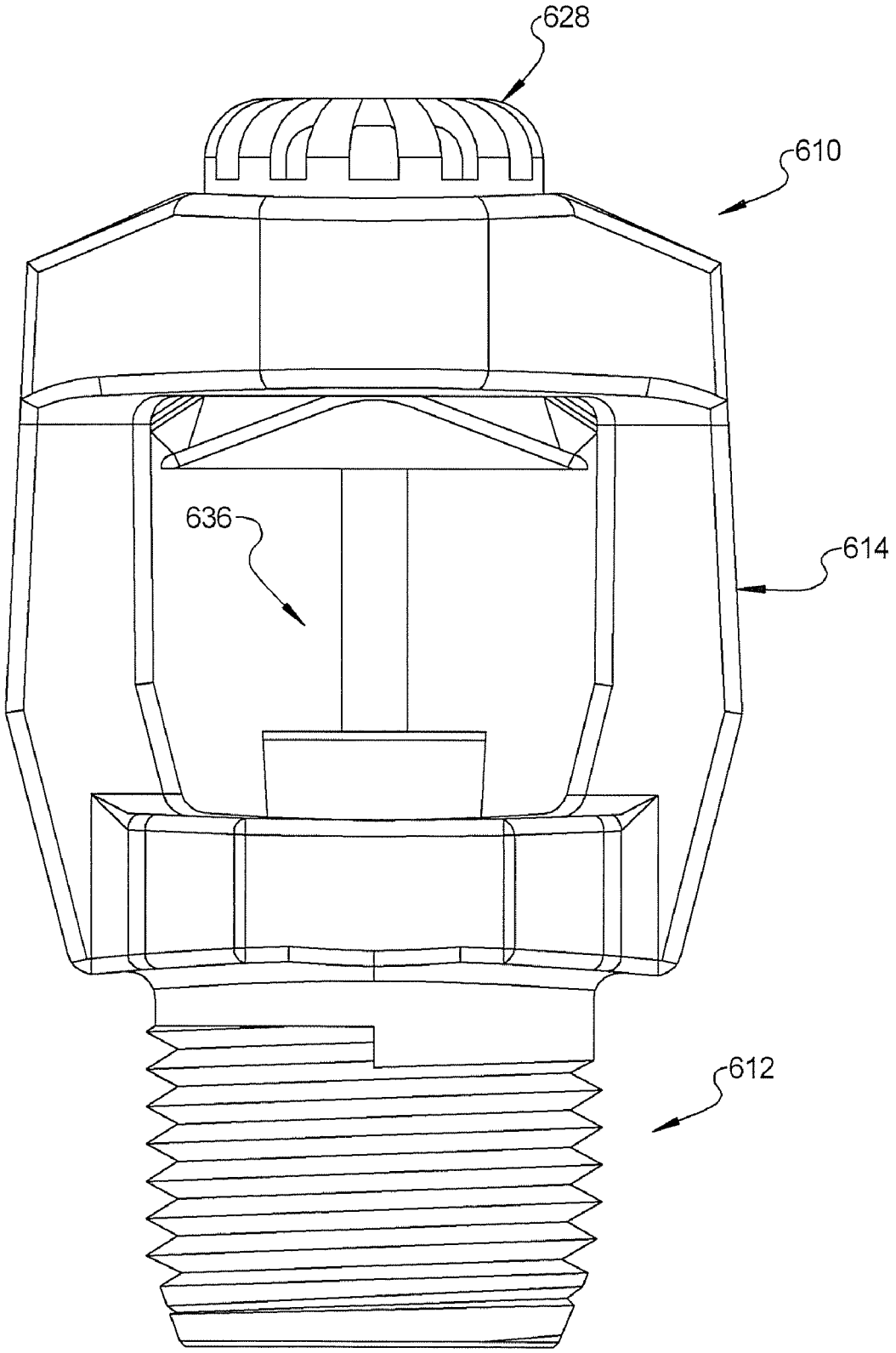
FIG. 25 is a side elevation view of the sprinkler assembly of FIG. 24 in its assembled configuration.
Figure 26:
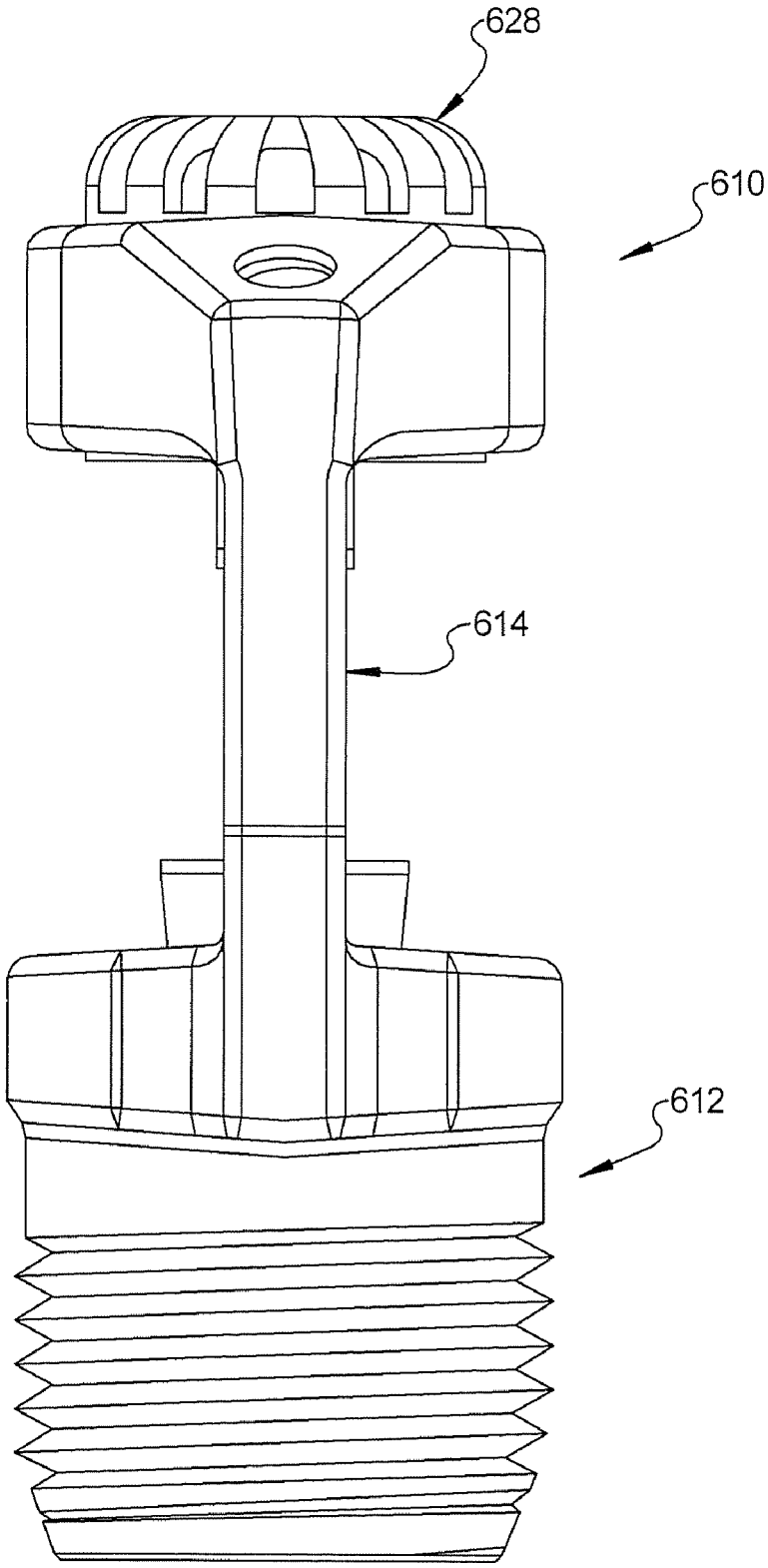
FIG. 26 is a second side elevation view of the sprinkler head of FIG. 25.
Figure 27:
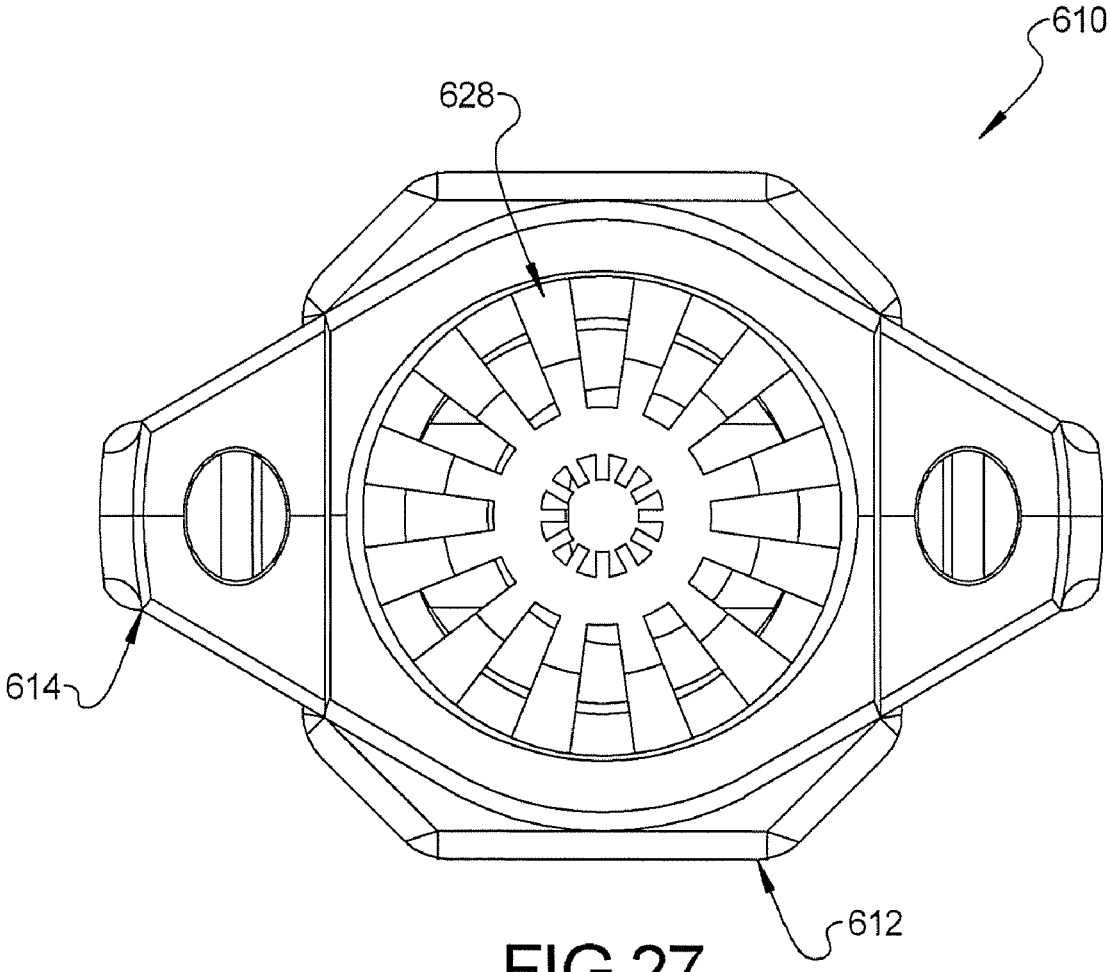
FIG. 27 is a top plan view of the sprinkler assembly of FIG. 26.
Figure 28:
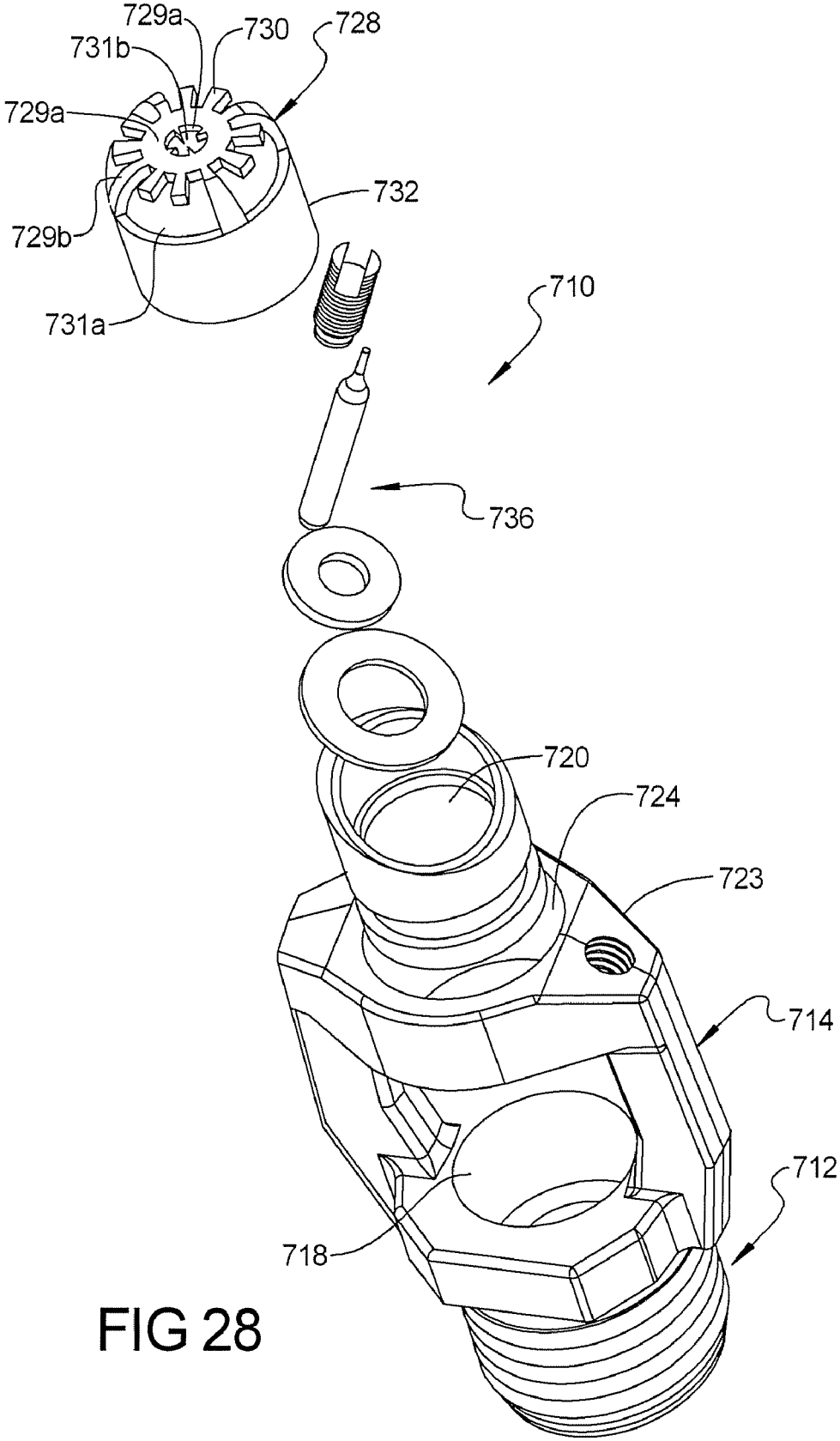
FIG. 28 is an exploded perspective view of an eighth embodiment of the sprinkler assembly of the present disclosure.
Figure 29:
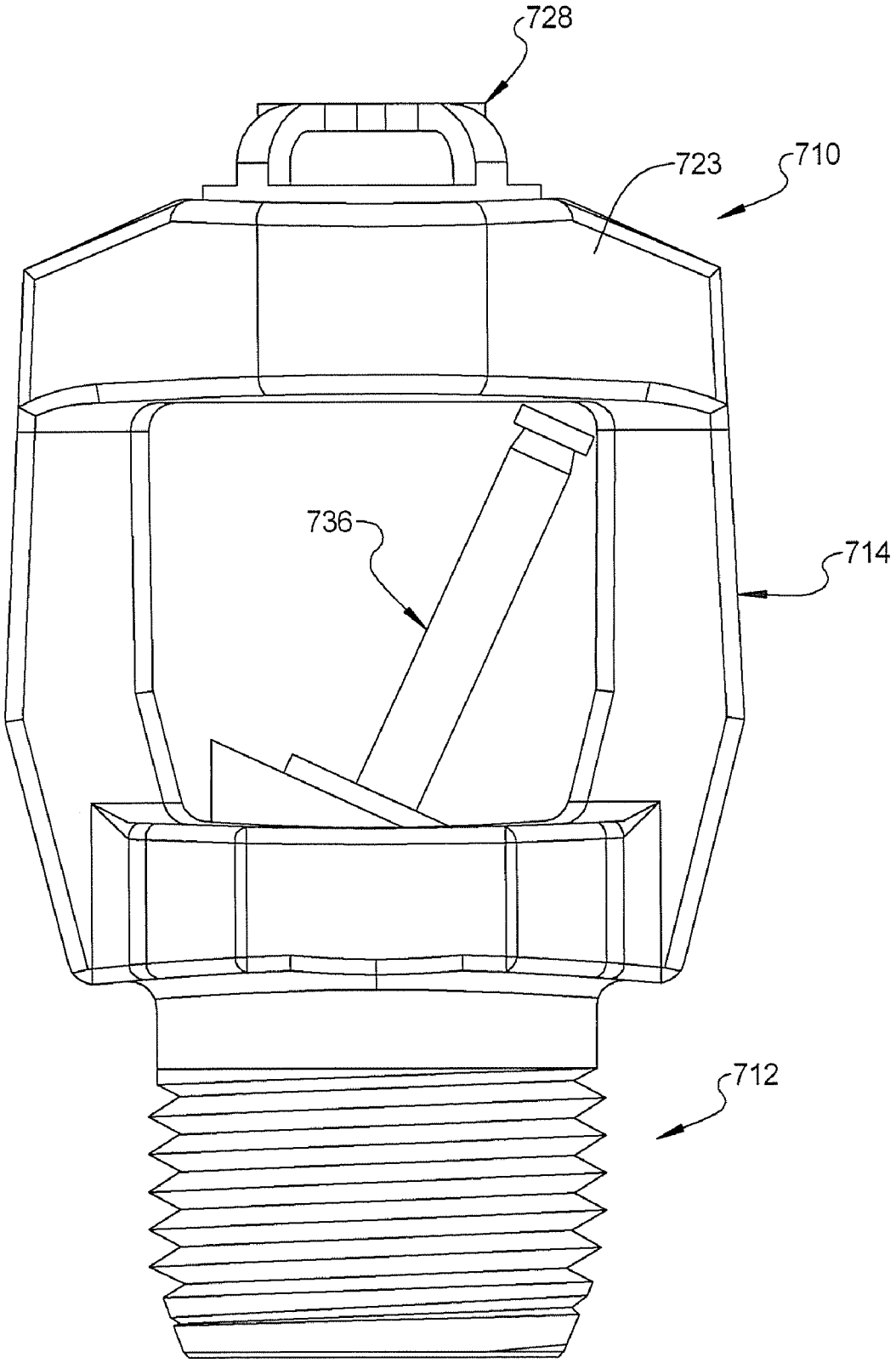
FIG. 29 is a side elevation view of the sprinkler assembly of FIG. 28 in an assembled state.
Figure 30:
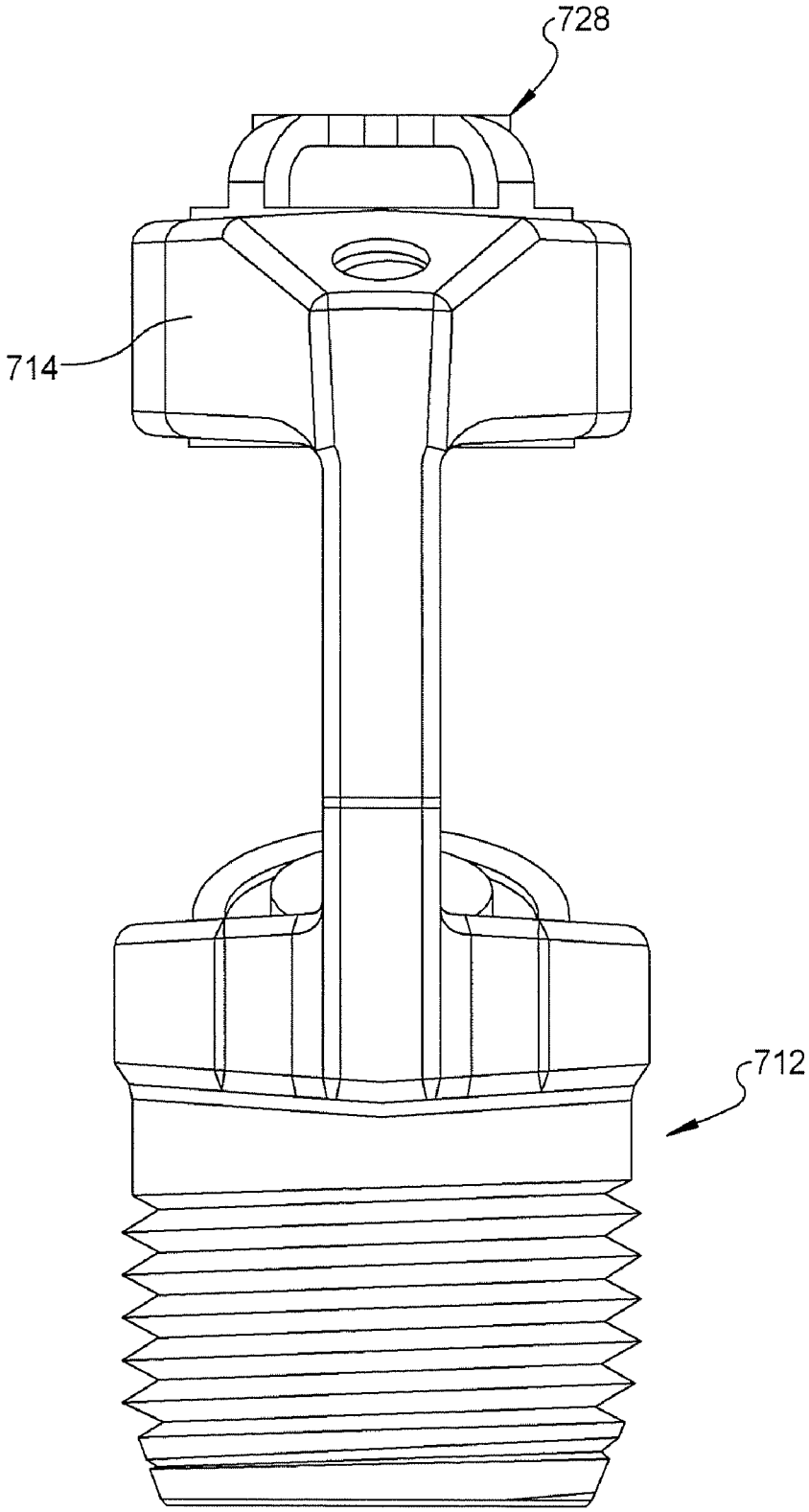
FIG. 30 is a second side elevation view of the sprinkler assembly of FIG. 29.
Figure 31:
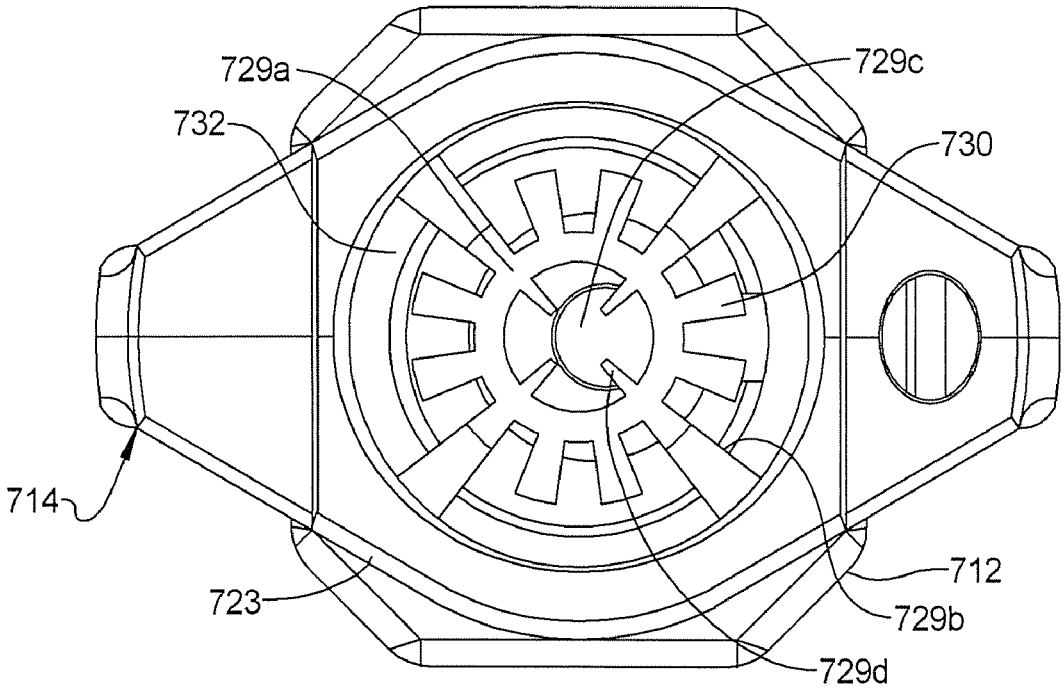
FIG. 31 is a top plan view of the sprinkler assembly of FIG. 30.
Figure 32:
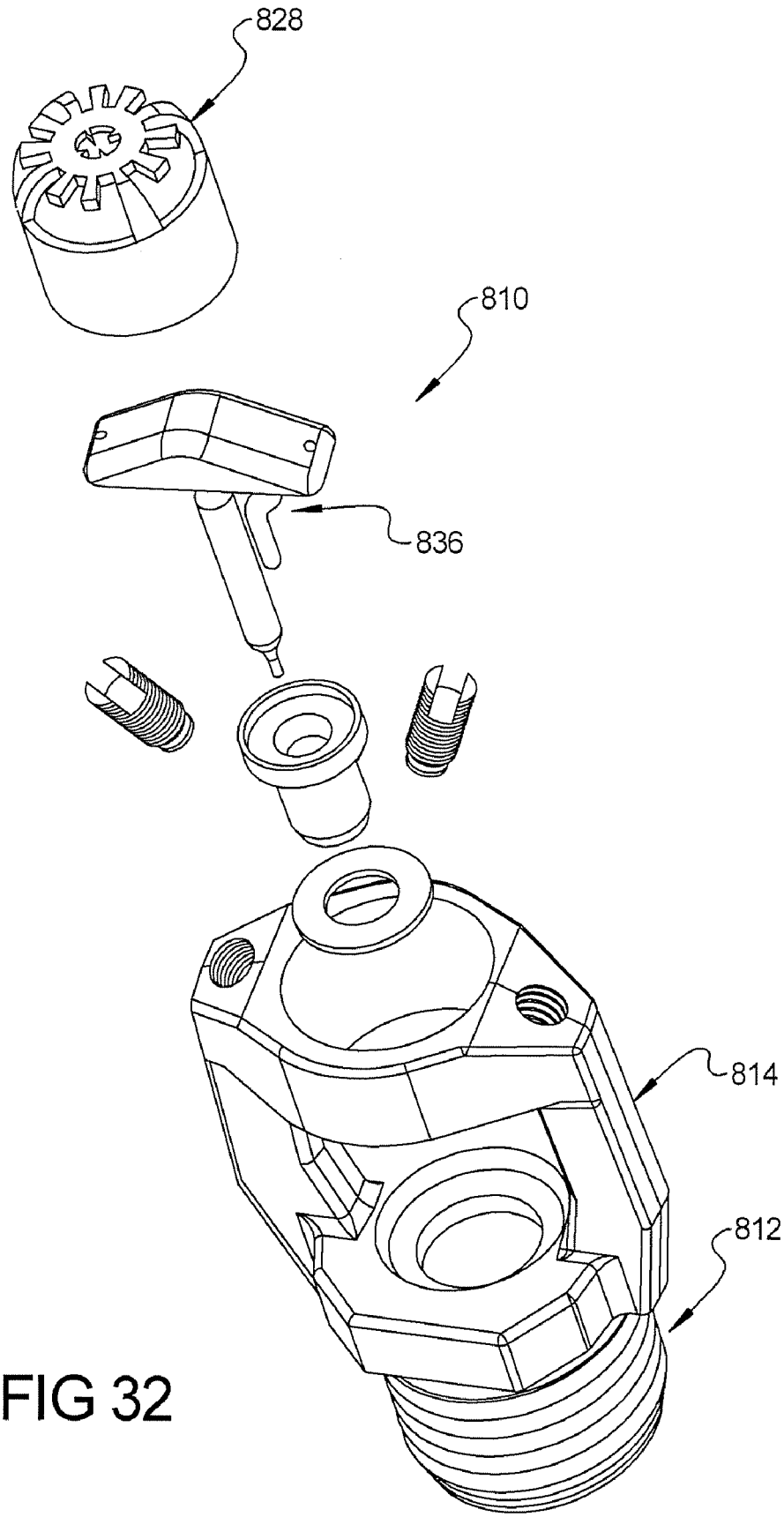
FIG. 32 is an exploded perspective view of a ninth embodiment of the sprinkler assembly of the present disclosure.
Figure 33:
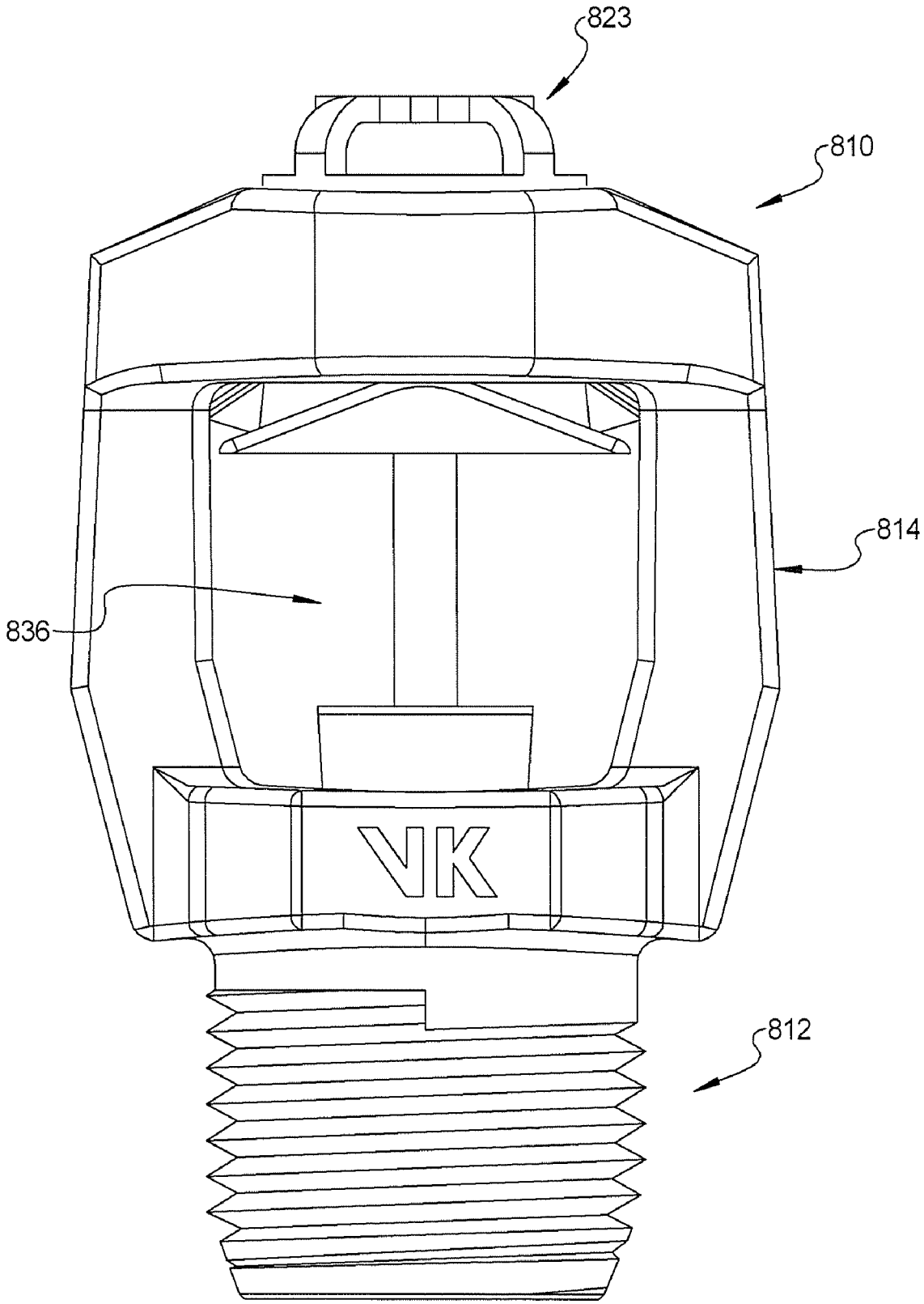
FIG. 33 is a side elevation view of the sprinkler assembly of FIG. 32 in its assembled configuration.
Figure 34:
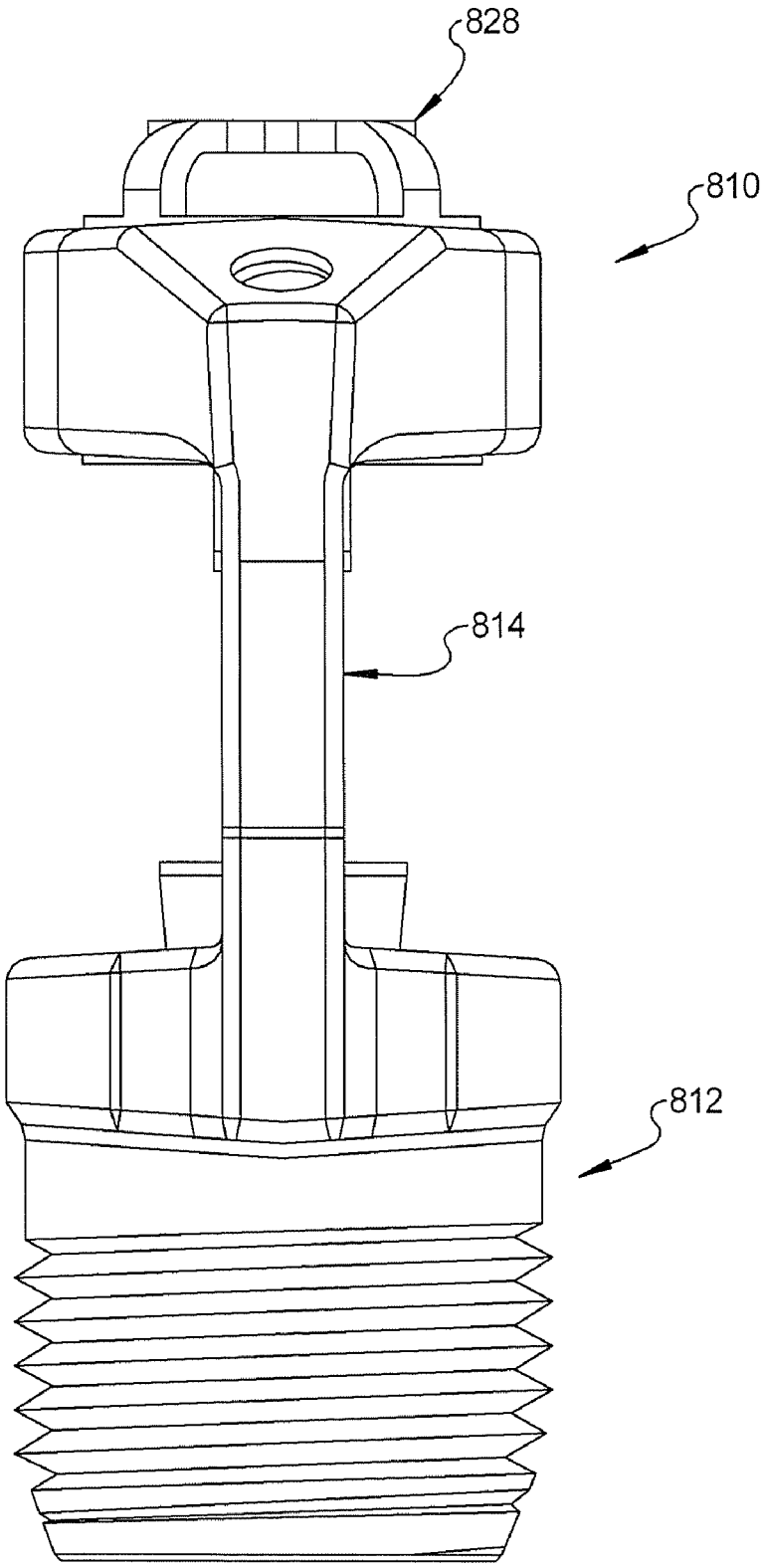
FIG. 34 is a second side elevation view of the sprinkler assembly of FIG. 33.
Figure 35:
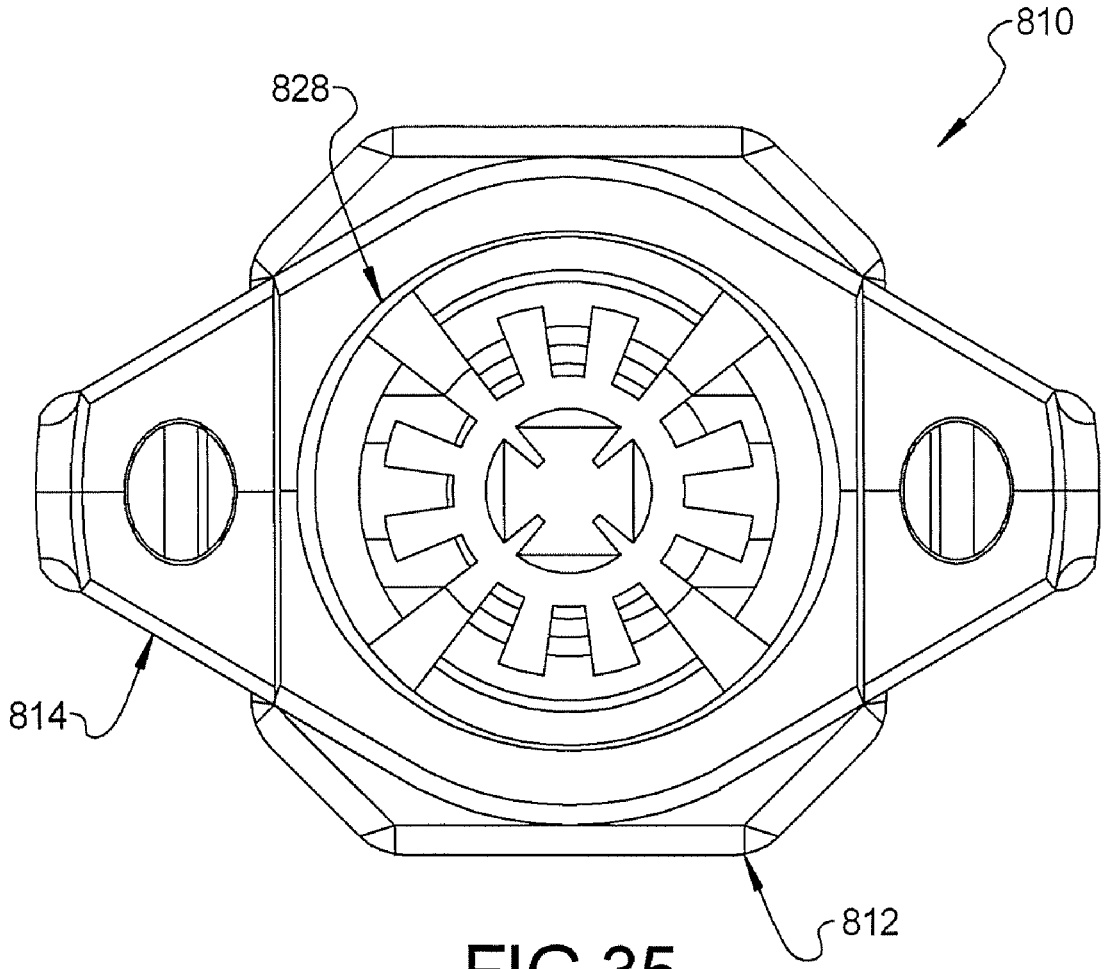
FIG. 35 is a top plan view of the sprinkler assembly of FIG. 32.

As best seen in FIG. 23, flow-shaper 528 includes a plurality of fingers or tines 530 that are mounted or formed on a cylindrical wall or an annular member 532, which is positioned in opening 524 of transverse member 523, but which are joined at their respective distal ends 530*d* by an annular member 531. Annular member 531 has an outer diameter greater than the diameter of discharge opening 20. For example, the minimum outer diameter of annular member 531 is 0.005 or more inches greater than the maximum diameter of discharge opening 520. In illustrated embodiment, member 531 comprises an annular plate with a planar inner surface (surface facing discharge opening 520) and a planar outer surface which faces in the direction along axis 526 away from body 512.

Similar to tines 430, tines 530 extend from annular member 532 outwardly (away from body 512) and are bent or rolled radially inward toward axis 526 and, further, so that the end portions 530*a* of tines 530 lie in a common plane spaced outwardly from opening 524 (away from body portion 512). In addition, each tine 530 includes tapered side edges 530*b*, 530*c* so that when tines 530 are bent or rolled toward axis 526, tines 530 are spaced apart to form radially arranged spaces or passageways or slots 531*a* through which the fluid flowing from discharge opening and through opening 524 can flow. As noted, the distal ends 530*d* of tines 530 are joined by member 531, with a central circular opening 531*b*. Opening 531*b* is preferably aligned along axis 526 of body 512. Further, opening 531*b* preferably has a diameter less than the diameter of discharge opening 520.

Optionally, member 531 may include a plurality of inwardly projecting finger or tines 531*c* that extend radially inward toward axis 526 into opening 531*b*. In the illustrated embodiment tines 531*c* are rectangular in shape and are evenly spaced around opening 531*b* and, further, have the same or comparable lengths. Alternately, tines 531*c* may have triangular shapes and/or have different lengths. In addition, tines 531*c* may be spaced around opening in a non-uniform arrangement.

In this manner flow-shaper 528, like the flow-shaper members of the previous embodiments, generates a lower friction loss in the fluid as the fluid flows from the sprinkler assembly. In addition, some of the fluid flowing from discharge opening 520 may pass through flow-shaper 528 without contacting any structure.

Referring to FIGS. 24-27, the numeral 610 generally designates a seventh embodiment of the sprinkler assembly of the present disclosure similar to sprinkler assemblies 110, 210, 310, and 510, with a trigger 636 similar to trigger 336 and a flow-shaper 628 similar to flow-shaper 528. For the general details of body 612 and frame 614, reference is, therefore, made to bodies 112, 212, 312, and 512 and frames 114, 214, 314, and 514. For details of flow-shaper 628, reference is made to flow-shaper 528. Sprinkler assembly 610 is similarly configured as a pendent sprinkler and may be used in commercial or residential applications and, further, may be used in a suppression or control mode.

Referring to FIGS. 28-31, the numeral 710 generally designates an eighth embodiment of the sprinkler assembly of the present disclosure, which is similar to sprinkler assemblies 10, 110, and 510, with a modified flow-shaper 728. For the general details of frame 714, body 712, closure device 739, and trigger 736, reference is made to frames 14, 114, and 514, bodies 12, 112, and 512, closure devices 39, 139, and 539, and triggers 36, 136, and 536.

In the illustrated embodiment, flow-shaper 728 includes an annular member 729*a* and a plurality of fingers or tines 730 that extend radially outward from annular member 729*a*. Tines 730 and annular member 729*a* are supported by a cylindrical wall or annular member 732 that inserts into opening 724 of transverse member 723. Tines 730 and annular member 729*a* are supported by a cylindrical wall 732 and spaced therefrom by a plurality of radially extending, circumferentially spaced arms 729*b*. Notably as in the case of any of the flow-shaper members, tines 730, annular member 729*a*, annular member 732, and arms 729*b* may be formed as a single member or may be assembled and joined together by, for example, welding.

Similar to the previous embodiments, flow-shaper 728 is mounted to frame 714 by annular member 732, which is positioned in opening 724 of transverse member 723. Tines 730 extend in a common plane from annular member 729*a* and are radially spaced between arms 729*b*. Further, tines 730 have generally equal length but terminate inwardly of the inner circumference of annular member 732 to thereby define through passageways 731*a* between tines 730 and annular member 732 through which the fluid flowing from discharge opening 720 and through opening 724 can flow. Further, annular member 729*a* includes an opening 731*b*, which may have a maximum diameter less than the minimum diameter of discharge opening 720. Optionally, flow-shaper 728 includes a second plurality of tines 729*d* that extend radially inwardly from annular member 729*a* into central opening 731*b*. In this manner, flow-shaper 728, like the flow-shapers of the previous embodiments, generates lower friction and results in a lower head loss in the fluid flowing from sprinkler assembly 710.

Referring to FIGS. 32-35, the numeral 810 generally designates another embodiment of the sprinkler assembly of the present disclosure similar to sprinkler assembly 710, with a modified body 812, frame 814, closure device 839, and trigger 836. Therefore, for general details of flow-shaper 828, reference is made to flow-shaper 728. For further details of body 812, frame 814, closure device 839, and trigger 836, reference is made to bodies 312,612, frames 314, 614, closure devices 339, 639, and triggers 336, 636.

Figure 36:
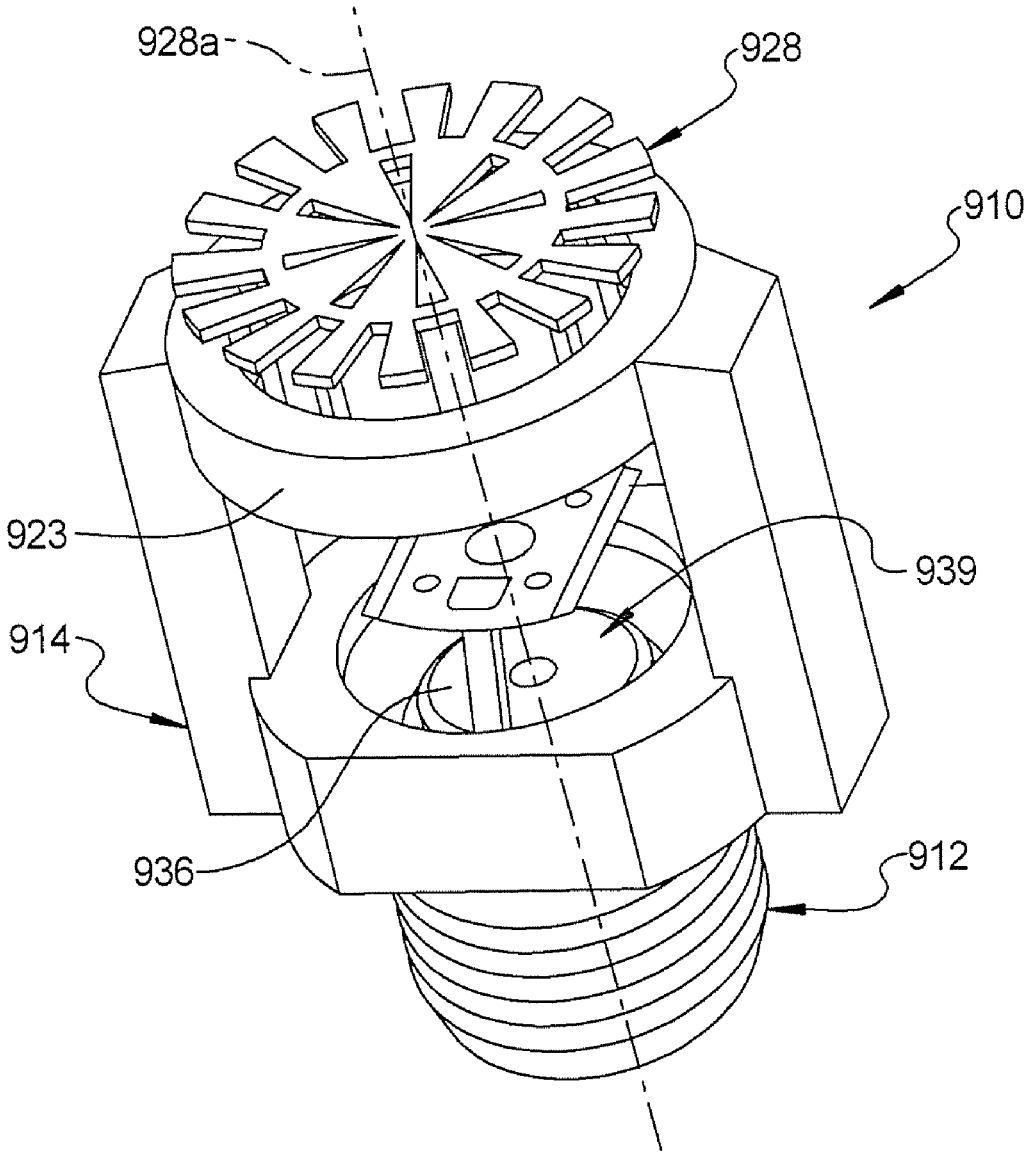
FIG. 36 is a perspective view of another embodiment of the sprinkler assembly of the present disclosure.
Figure 37:
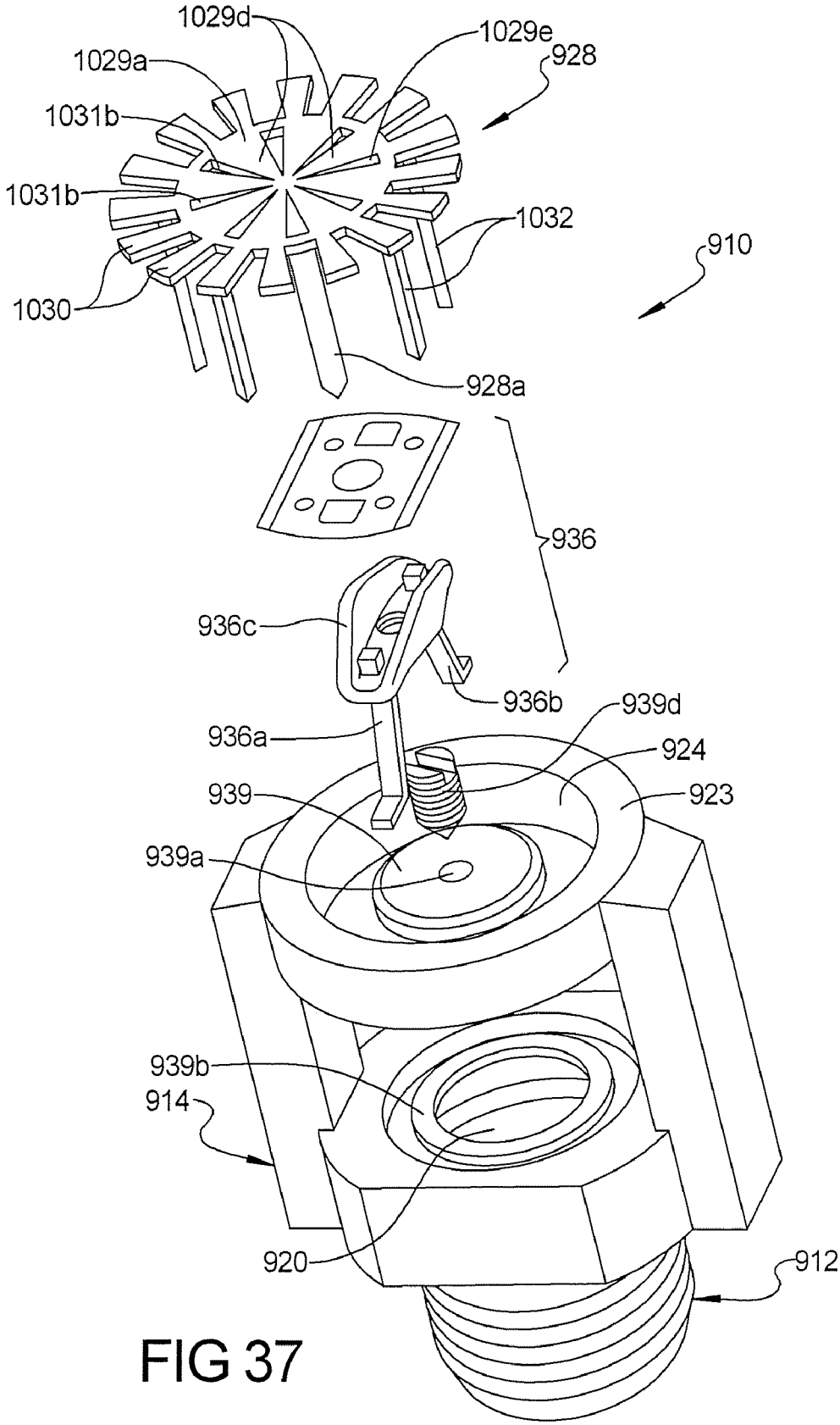
FIG. 37 is an exploded perspective view of the sprinkler head of FIG. 36.

Referring to FIGS. 36 and 37, the numeral 910 generally designates another embodiment of a sprinkler assembly of the present disclosure. Sprinkler assembly 910 comprises an early suppression fast response sprinkler (ESFR) and includes a sprinkler body 912, a frame 914, which extends from body 912, a closure device 939, and a trigger 936. Frame 914 is of similar construction to the previous embodiment and includes an annular member 923, which is spaced from body 912 by a pair of arms 914*a* and 914*b*. Further, mounted in opening 924 of annular member 923 is a flow-shaper 928, as will be more fully described below.

Closure device 939 comprises a disk 939*a* that rests on an annular seal 939*b* provided at discharge opening 920. In the illustrated embodiment, trigger 936 comprises a pair of plates that are joined by fusible material and are mounted adjacent the discharge opening of body 912 by pair of lever arms 936*a* and 936*b*. Arms 936*a* and 936*b* extend through a lever support 936*c* and are biased outwardly from base 912 by a set screw 939*d* that is threaded into lever support 939*c* and engages disk 939*a*. For further details of a suitable trigger, reference is made to U.S. Pat. No. 6,367,559, which is commonly owned by The Viking Corp. and which is incorporated herein by reference in its entirety.

Similar to flow-shaper 728, flow-shaper 928 includes an annular member 1029*a* and a plurality of fingers or tines 1030 that extend radially outward from annular member 1029*a*. Tines 1030 extend into a common plane from annular member 1029*a* and are radially spaced to thereby form a plurality of slotted openings around the periphery of flow-shaper member 928. Tines 1030 and annular member 1029*a* are supported by a plurality of elongate flanges 1032, which form an annular support that extends downwardly from annular member 1029*a* for insertion into annular member 923. In addition, flow-shaper 928 includes a second plurality of tines 1029*d* that extend inwardly from annular member 1029*a* into central opening 1031*b* of annular member 1029*a*. In the illustrated embodiment, the second plurality of tines 1029*d* comprise triangular-shaped tines, with distal ends 1029*e* that are spaced inwardly from the central axis 928*a* of flow-shaper 928 to thereby form a central opening 1031*b*. Alternately, the distal ends 1029*e* of tines 1029*d* may be joined, for example, by a second inner annual member. Second plurality of tines 1029*d* are radially spaced to form a second plurality of slotted openings inwardly of annular member 1029*a* and, further, that are in fluid communication with central opening 1031*b*. In addition, tines 1029*d* extend in the same plane as tines 1030 and annular member 1029*a*.

In the illustrated embodiment, annular member 1029*a* has a larger diameter than annular member 729*a* described in reference to flow-shaper 728. Further, although tines 1029*d* generally have equal lengths, they are generally greater in length than tines 729*d* of flow-shaper 728. Similar to flow-shaper member 728, central opening 1031*b* has a maximum diameter less than the minimum diameter of discharge opening 920.

As noted, any of the above-described sprinkler assemblies may be configured as a residential sprinkler or a commercial sprinkler, including a storage sprinkler. Hence, their "K" factor may vary, where the "K" factor equals the flow of fluid, such as water, in gallons per minute through the internal passageway divided by the square root of the pressure of fluid fed into the tubular body in pounds per square inch gauge. For example, the sprinkler assemblies may have a "K" factor of 2.8 to 50.4. Further at least sprinkler assemblies 410, 510, 610, 710, and 810 may be configured as suppression or control sprinklers. Hence, their RTI valves may vary from 10 to 300 $(m-s)^{1/2}$.

As would be understood from the foregoing description, the present disclosure provides a sprinkler assembly that reduces the energy loss in the fluid that flows from the sprinkler assembly. This may be achieved in a number of ways. First, the frame may be adapted to allow the fluid to flow through the frame substantially unimpeded—in other words the fluid is not dispersed and then redirected and, instead, it is directed by flow-shaper members. Though it should be understood in some applications some of the fluid may be redirected. Secondly, the sprinkler assembly may include one or more flow-shaper members that at least partially envelope the column of fluid as it flows from the discharge opening and, further, in most embodiments operates on the outer surface of the column of fluid and radially inward of the column so that the fluid is shaped in its desired direction, in essence, by a single contact with the flow-shaper member or members. This is in stark contrast to a conventional frame/deflector arrangement that requires essentially a two step process: (a) first the fluid is impinged on the frame, such as the conical boss that joins the frame's arms in most sprinkler assemblies, to redirect and disperse the fluid onto the deflector, and thereafter, (b) the fluid flows across and around the deflector, which then disperses the fluid in its final desired pattern. Thirdly, the trigger may be offset from the axis of the sprinkler body. Various combinations of these features are combined in the illustrated embodiments; however, it should be understood that any one or more of the features can be recombined with other features, including conventional features, to achieve an improved sprinkler assembly of the present invention. Further at least sprinkler assemblies 410, 510, 610, 710, and 810 may be configured as suppression or control sprinklers.

While several embodiments of the sprinkler assembly have been shown and described, other changes and modifications will be appreciated by those skilled in the art. For example, as previously noted, the frame and body may be formed as a single cast member. Alternately, the frame and body may be formed from separate components that are then assembled. The number and shape of the flow-shaper members may be varied. Further, as mentioned, the flow-shaper member or shaper members may be formed or mounted as an integral part of the frame. In addition, the sprinkler assembly may employ other types of trigger assemblies. Therefore, it will be understood that the embodiments shown in the drawings and described above are merely for illustrative purposes, and are not intended to limit the scope of the invention that is defined by the claims, which follow as interpreted under the principles of patent law including the doctrine of equivalents.

What is claimed is:

1. A method of assembling a sprinkler body, comprising:

providing a sprinkler body with a support extending from said sprinkler body, said sprinkler body including a passageway there through with an inlet opening and a discharge opening and an axis extending through said discharge opening;

mounting a closure member in said discharge opening; and mounting a heat responsive trigger mechanism having a first end disposed against said closure member and a second end contacting said support via at least one set screw laterally offset from said axis, wherein said heat responsive trigger includes a glass bulb having a first end directly engaging said closure member and a second end directly engaging said at least one set screw received in a threaded aperture in said support which is laterally spaced from said axis of said discharge opening.

* * * * *

UNITED STATES PATENT AND TRADEMARK OFFICE

CERTIFICATE OF CORRECTION

PATENT NO. : 8,151,462 B2
APPLICATION NO. : 12/724880
DATED : April 10, 2012
INVENTOR(S) : Scott T. Franson et al.

It is certified that error appears in the above-identified patent and that said Letters Patent is hereby corrected as shown below:

In the Specifications:

At column 17, line number 8, “annual member” should be --annular member--.

At column 17, line number 44, “envelope” should be --envelop--.

Signed and Sealed this
Fourth Day of September, 2012

David J. Kappos

David J. Kappos
*Director of the United States Patent and Trademark Office*